US009663260B2

(12) United States Patent
Morita et al.

(10) Patent No.: US 9,663,260 B2
(45) Date of Patent: May 30, 2017

(54) DRUG FEEDER

(71) Applicant: YUYAMA MFG. CO., LTD., Osaka (JP)

(72) Inventors: Yasuyuki Morita, Osaka (JP); Shinya Akamatsu, Osaka (JP)

(73) Assignee: YUYAMA MFG. CO., LTD., Osaka (JP)

( * ) Notice: Subject to any disclaimer, the term of this patent is extended or adjusted under 35 U.S.C. 154(b) by 231 days.

(21) Appl. No.: 14/169,687

(22) Filed: Jan. 31, 2014

(65) Prior Publication Data

US 2015/0217929 A1 Aug. 6, 2015

(51) Int. Cl.
*B65D 83/04* (2006.01)
*B65B 35/08* (2006.01)

(52) U.S. Cl.
CPC ..... *B65B 35/08* (2013.01); *B65D 83/04* (2013.01)

(58) Field of Classification Search
CPC .... B65B 5/103; B65D 83/04; B65D 83/0454; G07F 17/0092
See application file for complete search history.

(56) References Cited

U.S. PATENT DOCUMENTS 4,903,861 A * 2/1990 Yuyama ..... G07F 17/0092 221/265
7,258,248 B2 8/2007 Kim
7,669,733 B2 * 3/2010 Kim ..... G07F 11/54 221/261
8,430,269 B2 * 4/2013 Nam ..... B65B 35/06 221/119
2011/0170655 A1 7/2011 Yuyama et al.
(Continued)

FOREIGN PATENT DOCUMENTS

JP 3472018 12/2003
JP 4312859 8/2009
(Continued)

OTHER PUBLICATIONS

English language Abstract of JP 2007-202795 having a publication date of Aug. 16, 2007.
(Continued)

*Primary Examiner* — Gerald McClain
*Assistant Examiner* — Kelvin L Randall, Jr.
(74) *Attorney, Agent, or Firm* — Wenderoth, Lind & Ponack, L.L.P.

(57) ABSTRACT

A rotor rotates, thereby sequentially making pockets reach a drug discharging outlet, so that tablets held therein are sequentially discharged through the drug discharging outlet. When each pocket reaches the drug discharging outlet, an upper opening of the pocket is closed by a separating member, which prevents new tablets from dropping in the pocket. An apex of a block with a protrusion has a height that is able to contact a lower face of a main body of the separating member. The apex strokes the lower face of the main body of the separating member upon rotation of the rotor. Only branches with which the apex of the block with a protrusion is brought into contact bend and deform upwardly. The deformed branches are successively replaced, so as to proceed as waves running. The tablets are pushed by the waves so as to proceed forward in the rotational direction.

20 Claims, 22 Drawing Sheets

(56) References Cited

U.S. PATENT DOCUMENTS

| | | | | |
|---|---|---|---|---|
| 2011/0309101 | A1* | 12/2011 | Kokie | A61J 7/0007 221/30 |
| 2014/0084020 | A1* | 3/2014 | Yoshinori | G07F 11/005 221/82 |
| 2015/0027286 | A1* | 1/2015 | Yuyama | G07F 11/66 83/105 |
| 2015/0028047 | A1* | 1/2015 | Yuyama | G07F 11/66 221/1 |

FOREIGN PATENT DOCUMENTS

| | | |
|---|---|---|
| JP | 2011-45700 | 3/2011 |
| JP | 4691020 | 6/2011 |
| JP | 4805685 | 11/2011 |
| JP | 4914615 | 4/2012 |

OTHER PUBLICATIONS

English language Abstract of JP 2007-202796 having a publication date of Aug. 16, 2007.
English language Abstract of JP 09-240603 having a publication date of Sep. 16, 1997.
English language Abstract of JP 2000-128105 having a publication date of May 9, 2000.
English language Abstract of WO 2005/097600 having a publication date of Oct. 20, 2005.

* cited by examiner

ROTATIONAL DIRECTION

DRUG FEEDER

TECHNICAL FIELD

The present invention relates to drug feeders for feeding solid drugs such as tablets and capsules, and especially to a drug feeder having a function of dispensing the last drug until none is left.

BACKGROUND ART

Conventionally, devices such as a drug dispensing apparatus and a drug filling apparatus have a drug feeder for dispensing tablets contained therein one by one to a predetermined position. Some drug feeders employ a rotor provided with a one stage pocket region as described in Patent Documents 1 and 2 specified below and others employ a rotor provided with an upper and lower stage pocket region as described in Patent Documents 3, 4, 5, and 6 specified below. In any of them, each drug feeder is roughly composed of a drug cassette for accommodating a large number of tablets, a support base where the drug cassette is to be mounted, and a separating member, as disclosed in Patent Documents described below.

A drug cassette is provided with a storage part having a drug storage space for accommodating a large number of tablets with a rotor housed in the storage part. The rotor has drug storage grooves on the outer peripheral face of the rotor, so as to form a plurality of pockets in spaces between the grooves and an inner wall of the storage part. The pockets have a function of flowing in and holding the tablets contained in the storage part. The drug storage grooves each are opened at upper and lower sides. The pockets each are a space formed by the groove and the inner wall of the storage part, which closes an opening of the groove, and are opened at upper and lower sides.

The rotor has a rotating shaft on which a rotor gear is mounted. Further, the storage part has a drug discharging outlet at a position allowing communication with the drug storage groove disposed on the outer peripheral face of the rotor.

The separating member is of a plate shape or a comb-like shape and is attached to an upper part of the drug discharging outlet.

In a drug feeder provided with a rotor having a one stage pocket region as disclosed in Patent Documents 1 and 2, as shown in FIGS. 20A to E, a separating member 100 is located further above a pocket region 102 having drug storage grooves 101.

Specifically, as shown in FIGS. 20A to E, a row of the drug storage grooves 101 is arranged above a drug discharging outlet 103 and, moreover, above the row the separating member 100 is arranged.

The support base houses a motor such as a geared motor, a driving gear being mounted on a rotating shaft of the motor.

Upon driving of the motor housed in the support base, a rotational force is transferred from the driving gear to the rotor gear, thereby rotating a rotor 105 in a direction of an arrow as shown in FIGS. 20A to E, and further rotating the drug storage grooves 101 formed on the outer peripheral face of the rotor 105. The rotation of the rotor 105 agitates the tablets in the storage part, so that the tablets enter each pocket 108 through an opening 106 of the upper side of the pocket 108.

Further rotation of the rotor 105 allows the pockets 108 to reach the drug discharging outlet 103 in rotation, so that the tablets held in the pockets 108 are sequentially discharged through the drug discharging outlet 103, as shown in FIG. 20B.

Though each of the pockets 108 is a space opened at the upper and lower sides as described above, the opening 106 of the upper side of the pocket 108 is closed by the separating member 100 when the pocket 108 reaches the drug discharging outlet 103 since the separating member 100 is located above the drug discharging outlet 103 and further above the drug storage grooves 101.

The tablets held in each of the pockets 108 are sequentially discharged through the drug discharging outlet 103 when the relevant pocket 108 reaches the drug discharging outlet 103, and whereby the relevant pocket 108 becomes empty, but no tablet newly drops in the pocket 108 near the drug discharging outlet 103 because the opening 106 of the upper side of the pocket 108 is closed by the separating member 100 at the relevant position.

Consequently, only a specific number of tablets held in the pocket beforehand are discharged through the drug discharging outlet 103. As explained in an example shown in FIGS. 20A to E, only one tablet A having been held in the pocket 108 is discharged through the drug discharging outlet 103, while a tablet C right above the tablet A remains on the separating member 100.

Patent Documents 3, 4, 5, and 6 each disclose a drug feeder provided with a rotor having the upper and lower stage pocket region. In a case of the use of the rotor having the upper and lower stage structure, a separating member is disposed between the lower pocket region and the upper pocket region, thereby preventing more than a predetermined number of tablets from entering the lower pockets.

Patent Documents 3 and 4 each disclose an embodiment in which the upper pockets each have an opening with inclination so as to present concave and convex shapes.

The concaves and convexes of the rotor disclosed in Patent Documents 3 and 4 are positioned above the separating member so as not to be brought into contact with the separating member.

Patent Document 5 discloses a configuration in which the rotor has a block part on its side face, above which a projection is provided.

The projection disclosed in Patent Document 5 is located above the separating member so as not to be brought into contact with the separating member.

PATENT DOCUMENT

Patent Document 1: JP 4805685
Patent Document 2: JP 4914615
Patent Document 3: JP 3472018
Patent Document 4: JP 4312859
Patent Document 5: U.S. Pat. No. 7,258,248 B2
Patent Document 6: JP 4691020

DISCLOSURE OF INVENTION

Technical Problem

In each of the drug feeders provided with the rotor having the one stage structure as described in Patent Documents 1 and 2, tablets may remain in the storage part without dropping in the pockets when a small number of tablets remain therein. In sum, the drug feeder employing the rotor having the one stage structure as disclosed in Patent Documents 1 and 2 may fail to discharge all the tablets.

Specifically, in the drug feeder employing the rotor having the one stage structure, as shown in FIGS. 20A to E, a row of the drug storage grooves 101 is arranged above the drug discharging outlet 103 and, moreover, above the row the separating member 100 is arranged, so that more than a specified number of tablets is prevented from dropping in the pockets 108. More specifically, the separating member 100 receives tablets being about to dropping down.

Herein, in a case where a large number of tablets remain in the storage part, as shown in FIGS. 20C and D, as the tablets widely and wholly rotate following rotation of the rotor 105, the tablet C on the separating member 100 is pushed with the front and rear tablets to move to a rotational direction of the rotor 105. Finally, as shown in FIG. 20E, a tablet B is pushed away from the separating member 100.

Hence, when a large number of tablets remain in the storage part, no tablet stops on the separating member 100.

However, when a small number of tablets remain in the storage part as shown in FIG. 21A, the tablets do not wholly rotate as shown in FIGS. 21A, B, and C with the rotation of the rotor 105. Thereby, the tablet C on the separating member 100 becomes isolated and never leaves from that position. Therefore, in the drug feeder provided with the rotor 105 having the one stage structure, when a small number of tablets remain, the tablets fail to drop in the pockets 108, and whereby some tablets may remain in the storage part.

On the other hand, in the drug feeders each employing the rotor having the upper and lower stage pocket region as disclosed in Patent Documents 3, 4, 5, and 6, as shown in FIG. 22, the separating member 100 is disposed between the upper pocket region 110 and the lower pocket region 111, so that the separating member 100 has thereon no space for keeping the tablets. That prevents the tablets from remaining on the separating member 100.

However, the drug feeder provided with the rotor having the upper and lower stage structure may cause failures in order to discharge oval tablets shaped like an oval type or a football type or capsules.

The tablets include one with a round shape in a front view like a so-called flat type or go game stone type and one with an oval shape in a front view like a so-called an oval type or football type.

The drug feeder provided with the rotor having the upper and lower stage structure may cause failure in order to discharge such oval tablets.

Specifically, when oval tablets A and B are contained respectively in upper and lower pockets 120 and 121 as shown in FIG. 23A, the tablet A is discharged without any problems (FIG. 24).

However, when the oval tablets A and B are contained in disorder in the upper and lower pockets 120 and 121 as shown in FIG. 23B, the tablets A and B get stuck each other and are unable to move. Hence, though the tablets A and B hit against the separating member 100 when a part where the tablets A and B are located reaches the separating member 100 by the rotation of the rotor 105 as shown in FIGS. 25C and D, the tablets A and B fail to move away therefrom. That may break the tablets A and B or damage to the separating member 100. Alternatively, since the tablets A and B fit into the pockets 120 and 121 and are unable to move, abnormal noise may occur due to pressure of the tablets A and B on between the rotor 105 and the inner wall of the storage part in rotation of the rotor 105. Further getting stuck strongly may stop the rotation of the rotor 105.

In the drug feeders each employing the rotor having the upper and lower stage pocket region as disclosed in Patent Documents 3, 4, 5, and 6, when tablets with a large outer shape or less smooth tablets are discharged, some of the tablets may remain in the storage part without dropping into the pockets. Specifically, even in a case of tablets with a round shape in a front view like a so-called flat type or go game stone type, some of large tablets and/or some of less smooth tablets may remain in the storage part when such tablets are discharged.

More specifically, in the drug feeder employing a rotor 130 provided with an upper and lower stage pocket region 131, the pocket region 131 cannot help increasing its total height as shown in FIGS. 26A and B. Therefore, referring to FIGS. 26A and B, the difference in level between an inclined face 132 of the rotor 130 and each of blocks 133 constituting a pocket 135 is small. When a tablet A is large or less smooth, the tablet A may be caught in between an upper face 136 of the block 133 and an edge part of the inclined face 132 and remain in the storage part without dropping in the pocket 131.

Further, though the way of providing a pin 131 on a side of the rotor 130 in order to move it away from the upper face of the separating member 100 following the rotation of the rotor 130 as shown in FIGS. 27A and B has been discussed, it might have a problem of damage to the tablets due to hitting of the pin 131 against the tablets in a case where a large number of tablets are contained in the storage part as shown in FIG. 28.

Taking into account the above-mentioned problems and drawbacks of the known art, the present invention therefore aims to develop a drug feeder ensuring complete discharge of all tablets and having less failures even when oval tablets are used.

Solution to Problem

An aspect of the present invention to solve the above-mentioned problems and drawbacks is a drug feeder including a storage part having a drug storage space for accommodating a large number of solid drugs and a drug discharging outlet for discharging the drugs, a rotor having drug storage grooves on its side face, and a separating member, the rotor being rotatably installed in the storage part, an inside of the storage part and the drug storage groove of the rotor constituting a pocket, which has an opening at its upper side toward a side of the drug storage space so as to enable the drugs in the drug storage space to drop in, the separating member being located adjacent to the opening of the pocket coming to above the drug discharging outlet so as to occupy a predetermined amount of area planarly, thereby preventing more than a predetermined number of drugs from dropping in the pocket, and the drug feeder performing operation for sequentially discharging the drugs held in the pocket through the drug discharging outlet by sequentially communicating the pocket with the drug discharging outlet according to rotation of the rotor, which is rotated with the drugs in the storage part held in the pocket, wherein the drugs on the separating member are moved by hitting a part of the rotor against a part of the separating member so as to give a motion to the separating member associated with the rotation of the rotor.

In this aspect or another aspect described below, "solid drugs" indicate the whole range of solid drugs such as tablets and capsule drugs.

Similarly to the prior art, the drug feeder in this aspect rotates the rotor so as to sequentially discharge drugs held in the pocket through the drug discharging outlet. The drugs are, for example, discharged one by one at time intervals.

Further, the drug feeder in this aspect includes the separating member, which inhibits discharge of more than a predetermined number of drugs from the pocket. Specifically, the separating member is disposed adjacent to the opening of the pocket, so that only the drugs below the separating member are discharged through the drug discharging outlet without new drugs dropping below the separating member.

The separating member occupies a predetermined amount of area planarly, thereby allowing the drugs to lie thereon. However, in the drug feeder in this aspect, a part of the rotor hits against a part of the separating member associated with rotation of the rotor, which gives a motion to the separating member, thereby moving the drugs on the separating member. Therefore, even when a small number of drugs remain in the storage part, the last drug is discharged until none is left without being stopped on the separating member.

Another aspect of the present invention is a drug feeder including a storage part having a drug storage space for accommodating a large number of solid drugs and a drug discharging outlet for discharging the drugs, a rotor having drug storage grooves on its side face, and a separating member, the rotor being rotatably installed in the storage part, an inside of the storage part and the drug storage groove of the rotor constituting a pocket, which has an opening at its upper side toward a side of the drug storage space so as to in enable the drugs in the drug storage space to drop in, the separating member being located adjacent to the opening of the pocket coming to above the drug discharging outlet so as to occupy a predetermined amount of area planarly, thereby preventing more than a predetermined number of drugs from dropping in the pocket, and the drug feeder performing operation for sequentially discharging the drugs held in the pocket through the drug discharging outlet by sequentially communicating the pocket with the drug discharging outlet according to rotation of the rotor, which is rotated with the drugs in the storage part held in the pocket, wherein the drugs on the separating member are moved by rotating either a member to rotate with the rotor or a member to be rotatable separately from the rotor and hitting the member against a part of the separating member so as to give a motion to the separating member.

The drug feeder in this aspect has either a member to rotate with the rotor or a member to be rotatable separately from the rotor. The member rotates so as to hit against a part of the separating member, which gives a motion to the separating member, thereby moving the drugs on the separating member. Therefore, even when a small number of drugs remain in the storage part, the last drug is discharged until none is left without being stopped on the separating member.

Preferably, the separating member is disposed so as to extend in substantially a horizontal direction with the drugs loaded on its upper face.

In the drug feeder in this preferred aspect, the separating member is disposed so as to extend in substantially a horizontal direction, thereby preventing extra drugs from entering the pocket. On the other hand, this aspect is effective because the drugs are easily loaded on the separating member.

Preferably, the rotor is provided with blocks on the side face at intervals, and the drug storage groove is formed by a gap between adjacent blocks, wherein at least a part of an upper face of each block hits against a lower face of the separating member associated with the rotation of the rotor.

In the drug feeder in this preferred aspect, a part of or all of the upper face of the block hits against the lower face of the separating member associated with the rotation of the rotor. Herein, the blocks constitute the pockets and are disposed on the side face of the rotor at intervals. Thus, the lower face of the separating member is intermittently pressed. Moreover, a pressed part moves according to the rotation of the rotor. That moves the drugs on the separating member.

Preferably, the rotor is provided with a protrusion, wherein the protrusion hits against the lower face of the separating member associated with the rotation of the rotor.

In the drug feeder in this preferred aspect, the lower face of the separating member is intermittently pressed. Moreover, a pressed part moves according to the rotation of the rotor. That moves the drugs on the separating member.

Preferably, the rotor is provided with blocks on its side face at intervals, wherein the blocks include both a block with the protrusion to hit against a lower face of the separating member and a block with no protrusion.

This preferred aspect reduces the number of times for pressing the separating member. That provides the separating member having a long life.

Preferably, the protrusion has an apex with inclined faces in a front part and a rear part of the apex in a rotational direction.

In this preferred aspect, the protrusion has the inclined face in the front part in the rotational direction, which gradually increases a force to press the separating member and deformation given to the separating member when the rotor rotates in a forward direction, thereby giving less impact to the separating member. That provides the separating member having a long life.

In the drug feeder, stuck drugs may be removed by rotating the rotor backward when the drugs get stuck. This aspect is provided with the inclined face in the rear part in the rotational direction, thereby preventing the protrusion from getting stuck when the rotor rotates backward.

Preferably, the inclined face toward a front end in the rotational direction is gentler than the inclined face toward a rear end in the rotational direction.

The inclined face toward the front end in the rotational direction faces toward the separating member when using the drug feeder, so as to have many opportunities to be rubbed against the separating member with great force. In contrast, the inclined face toward the rear end in the rotational direction is rubbed against the separating member with great force when the rotor rotates backward. The rotation of the rotor backward is less common due to be limited to a case where the drugs get stuck as described above. Hence, in this aspect, the inclined face toward the front end, which has many opportunities to be rubbed with great force, is made a gentle slope.

Preferably, the apex of the protrusion has a rounded cross section.

In the drug feeder in this preferred aspect, the apex of the protrusion has a rounded cross section, so that the separating member is less susceptible to damages.

Preferably, the separating member allows partial deformation, and a part against which either (1) a part of the rotor or (2) the member rotating separately with the rotor hits deforms larger than the other part, so that the deformed part moves to push out the drugs associated with the rotation of the rotor.

According to this preferred aspect, a member such as a part of the rotor hits against the separating member, whose upper face waves. Then, the wave proceeds to the rotational direction of the rotor according to the rotation of the rotor.

Thereby, the drugs on the separating member are pushed by the wave to move, and finally pushed away from the separating member.

Advantageous Effect of Invention

The drug feeder in the present invention discharges drugs in the storage part smoothly. Further, it is possible to discharge oval drugs.

DESCRIPTION OF EMBODIMENTS

Now, embodiments of the present invention will be described in detail below, making reference to the drawings. In the below description, a reference upper and lower positional relation is a standard attitude shown in FIG. 1, unless otherwise specifically noted.

Figure 1:
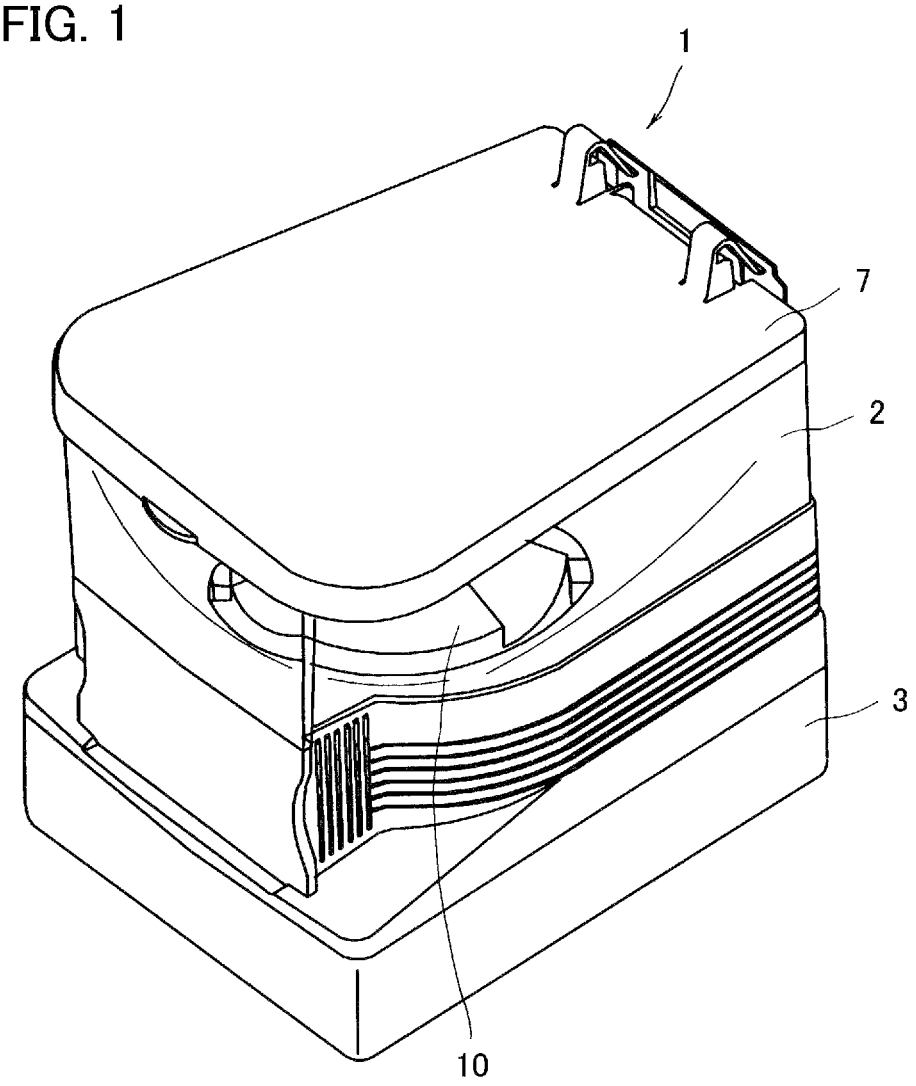
FIG. 1 is a perspective view of a drug feeder of an embodiment in this invention.
Figure 2:
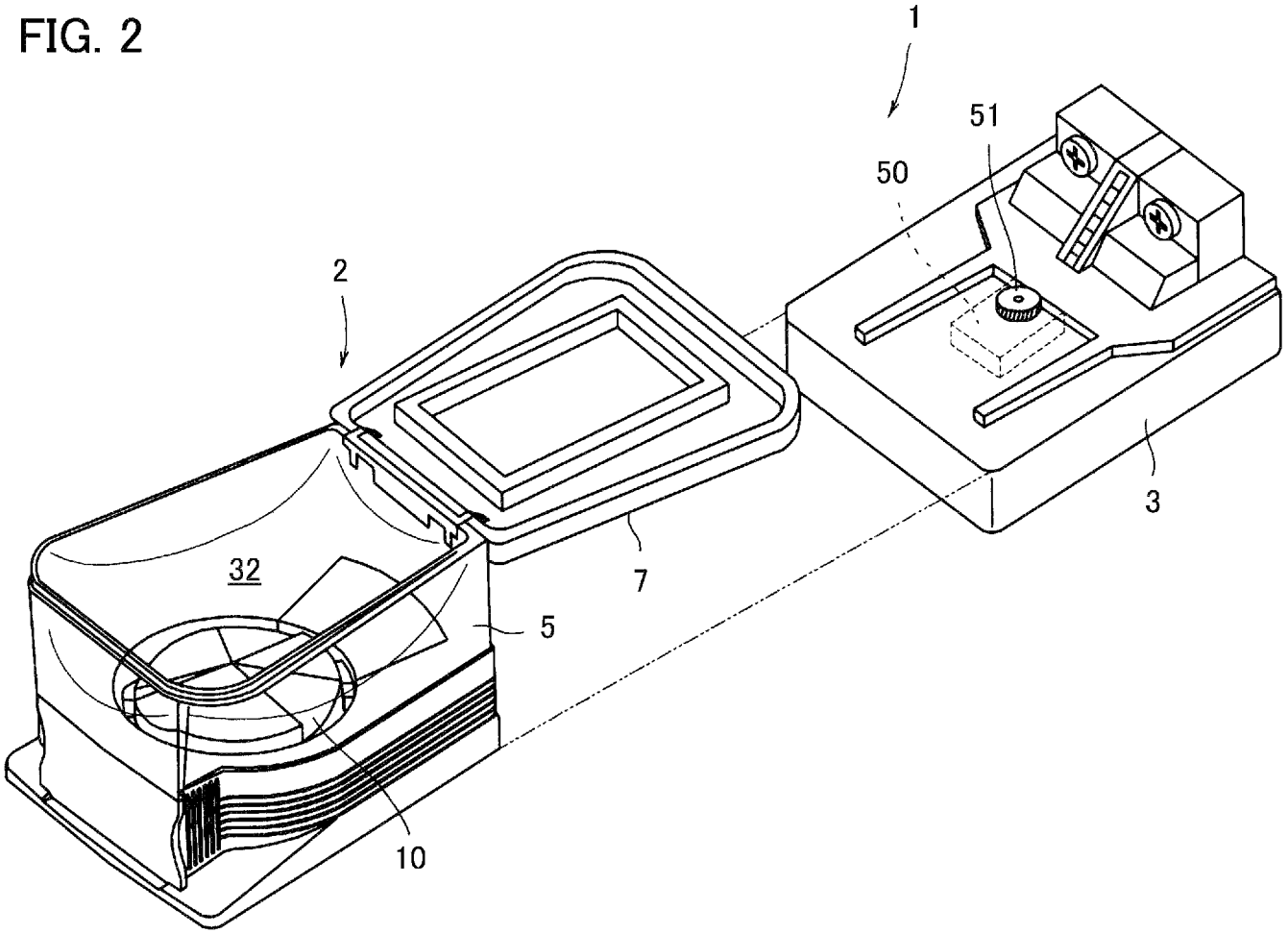
FIG. 2 is a perspective view of the drug feeder shown in FIG. 1 with a drug cassette and a support base separated.
Figure 3:
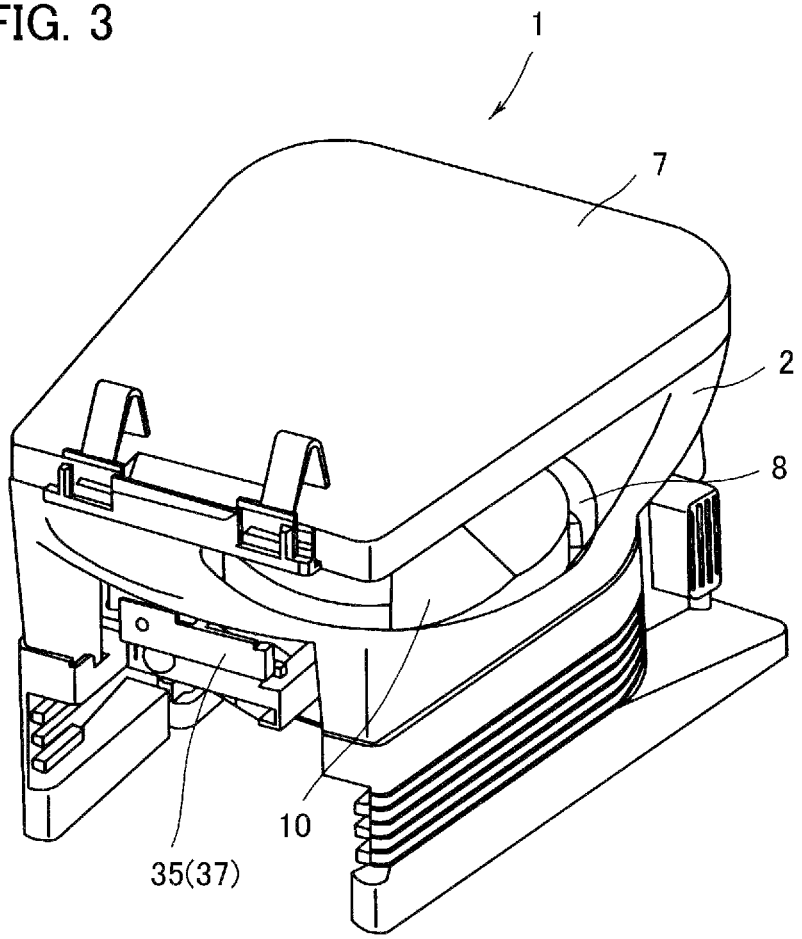
FIG. 3 is a perspective view of the drug cassette seen from a side of a drug discharging outlet.

In FIGS. 1 and 3, the numeral 1 designates a drug feeder of this embodiment. The drug feeder 1 is, as shown in FIG. 2, roughly composed of a drug cassette 2 and a support base 3 on which the drug cassette 2 is mounted.

The drug cassette 2 and the support base 3 can be separated, but a series of power transmission route from a motor 50 to a rotor 10 is completed by the both members coupled together, thereby rotating the rotor 10 upon reception of power from the motor 50.

Now, each component will be described below.

The drug cassette 2 is constituted by a storage part 5, the rotor 10, and a separating member 35. The storage part 5 is formed of synthetic resin.

The storage part 5 serves as a container for accommodating a large number of tablets and has a large drug storage space 32 inside. The storage part 5 is formed of transparent resin so that a remaining of tablets inside can be seen for visual confirmation.

Figure 5:
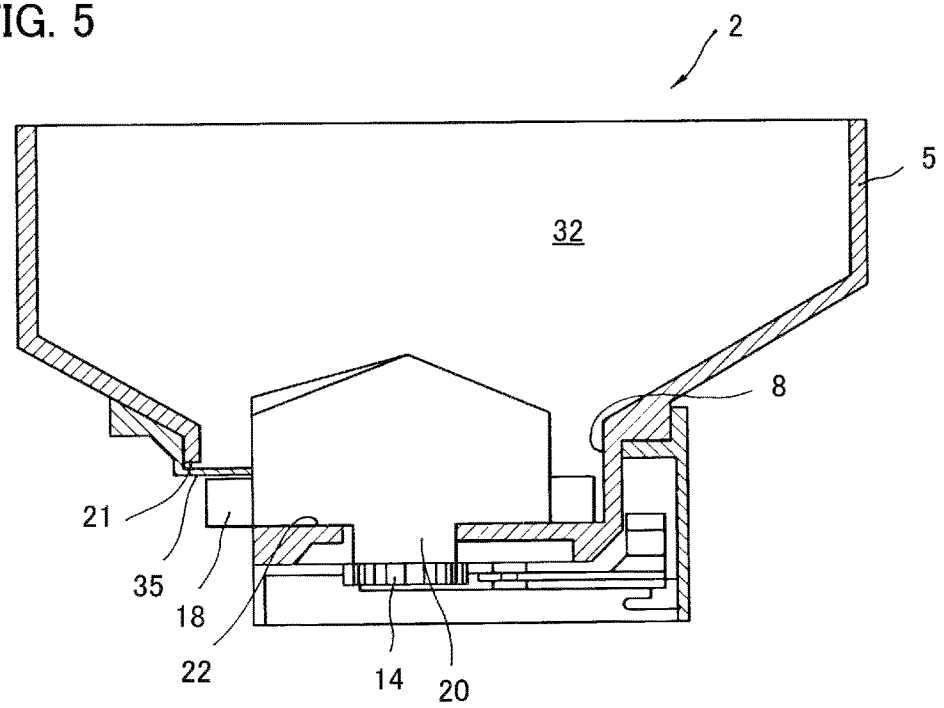
FIG. 5 is a cross section of the drug cassette.

The storage part 5 has a lid 7 for closing an opening attached detachably to its top face side. The storage part 5 has a concave portion 8 recessed downward as shown in FIG. 5 in substantially a central part of the bottom face of the storage part 5. The concave portion 8 has a circular plane section and opening The rotor 10 is rotatably housed in the concave portion 8. The concave portion 8 has a bottom with a bottom face 22 as shown in FIG. 5.

Figure 4:
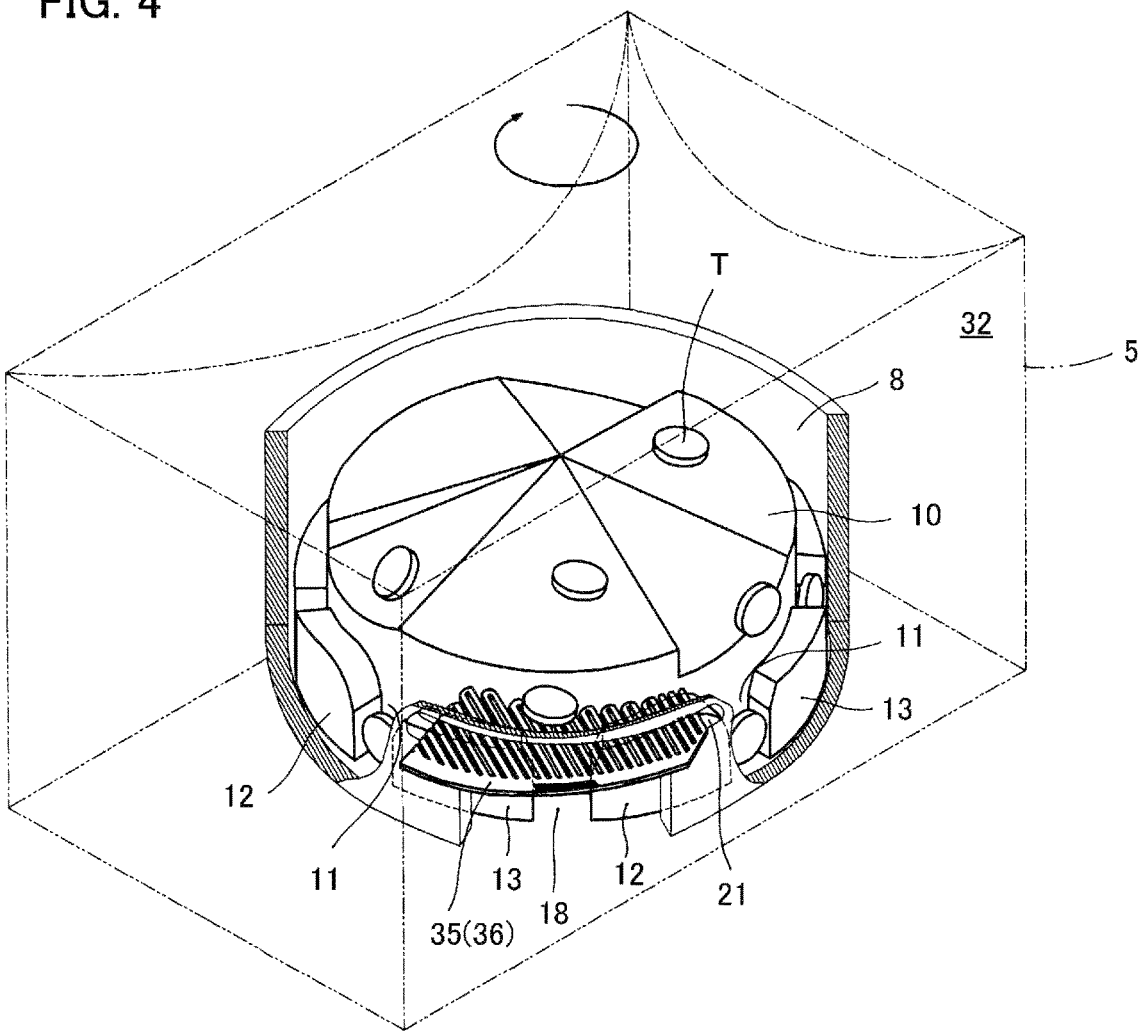
FIG. 4 is a perspective view of a schematic configuration of the drug cassette seen from the side of the drug discharging outlet.
Figure 6:
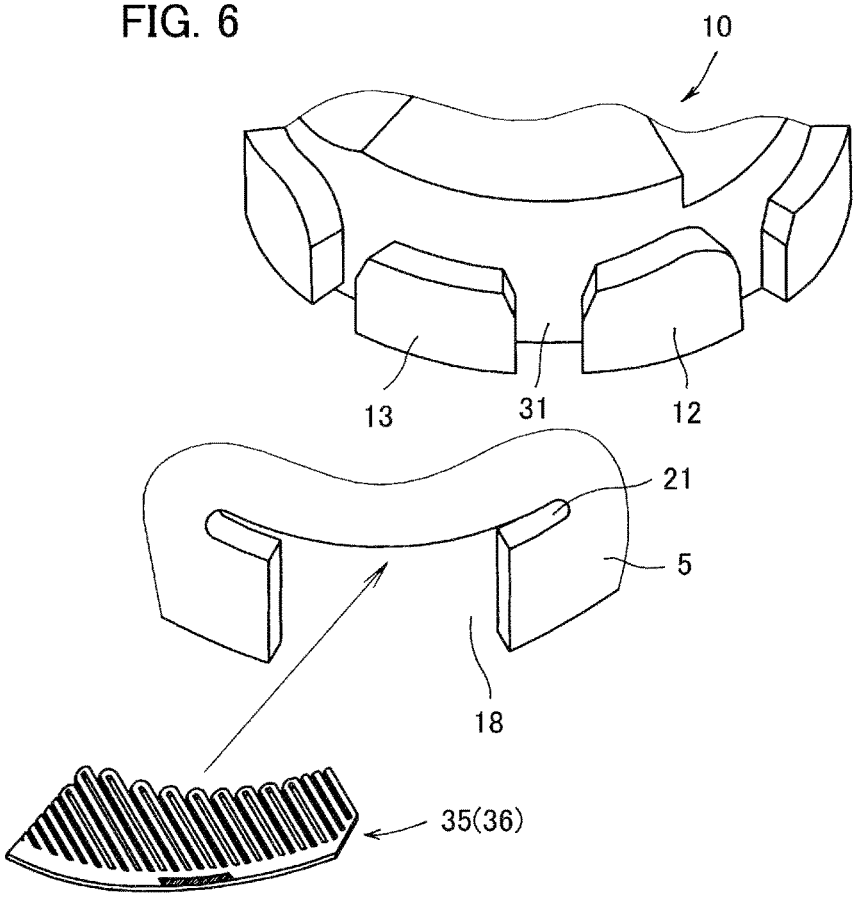
FIG. 6 is a perspective view of the drug cassette, showing a relationship among a separating member, the drug discharging outlet, and a rotor.

Referring to FIGS. 4, 5, and 6, there is provided a drug discharging outlet 18 at a lower part of the storage part 5.

There is provided a separating member insertion port 21 extending in a circumferential direction of the concave portion 8 above the drug discharging outlet 18 as shown in FIGS. 5 and 6.

In this embodiment, the separating member insertion port 21 communicates with the drug discharging outlet 18, whereas the separating member insertion port 21 does not necessarily need to communicate with the drug discharging outlet 18.

Figure 7:
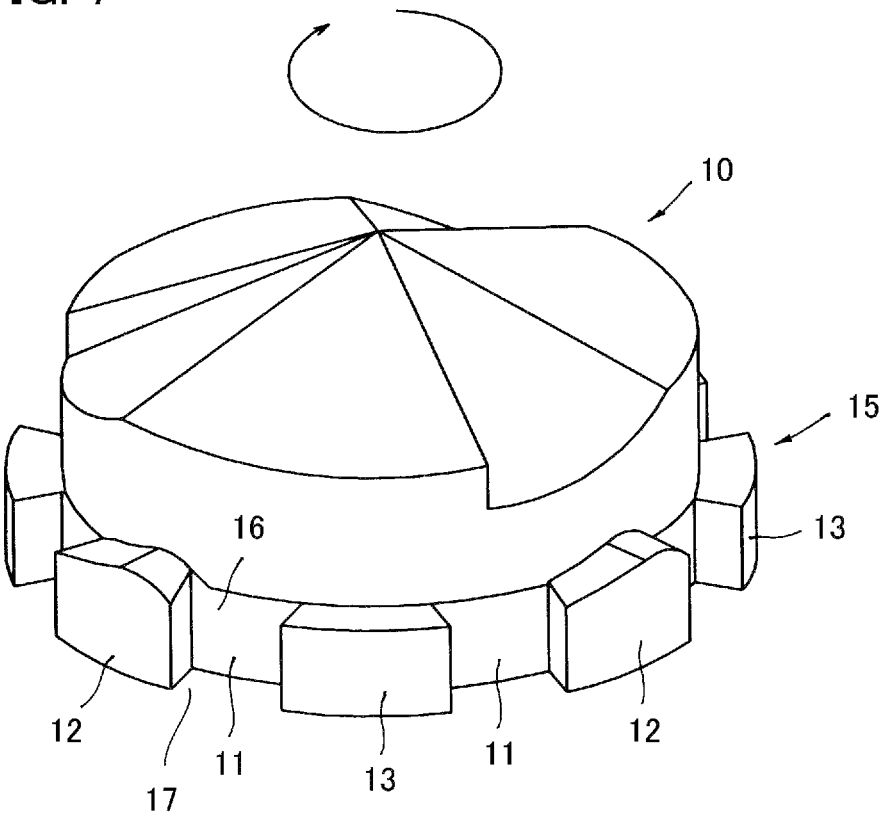
FIG. 7 is a perspective view of the rotor provided in the drug cassette.

Next, the rotor 10 will be described below. The rotor 10 has a top face constituting a conical inclined surface, as shown in FIG. 7, with a plurality of drug storage grooves 31 extending in an axial direction and formed at a plurality of positions at equal angles. In other words, the rotor 10 has a block forming region 15 on the outer peripheral surface thereof, which has a plurality of blocks 12 and 13 extending in a vertical direction. Adjacent blocks 12 and 13 forms the drug storage groove 31 extending in a vertical direction in the middle in a circumferential direction thereof. The both ends of the drug storage groove 31 are opened in an upper and lower direction of the rotor 10. Specifically, the drug storage groove 31 has an upper opening 16 and a lower opening 17.

In this embodiment, an opening face of the drug storage groove 31 is closed by an inner wall of the storage part 5, so that the three faces of the drug storage groove 31 and the inner wall of the storage part 5 forms a pocket 11 with its four faces closed. Consequently, the both ends of the pocket 11 are open in the upper and lower direction of the rotor 10. Hence, the pocket 11 has the upper opening 16 and the lower opening 17 described above.

Tablets having stopped on the rotor 10 sequentially slide down along the inclined face of the rotor 10 and enter the pocket 11 constituted by the inner wall of the concave portion 8 of the storage part 5 and the drug storage groove 31 of the rotor 10.

The pocket 11 has a width and a depth enough to accommodate only one tablet and a length (height) enough to accommodate one or more tablets.

This embodiment includes both the block 12 with a protrusion having a protrusion on a top face and the smooth block 13 with a flat top face.

Figure 8:
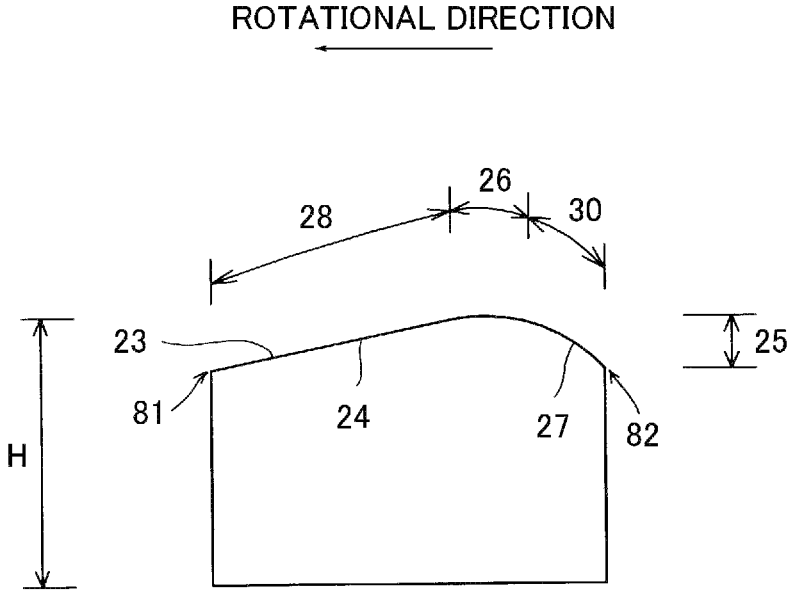
FIG. 8 is an enlarged front view of a block with a protrusion.

The block 12 with a protrusion has a protrusion 25 on a top face 23 as shown in FIGS. 7 and 8. An apex 26 of the protrusion 25 has roundness, with its end portion rounded.

Around the apex 26 are formed inclined faces 24 and 27. Specifically, on the basis in a rotational direction of the rotor 10, the inclined face 24 of a front part 28 in the rotational direction of the rotor is a gentle slope. Meanwhile, the inclined face 27 of a back part 30 in the rotational direction of the rotor is a slightly sharp slope.

The inclined face 24 located in front of the apex 26 is long, while the inclined face 27 located therebehind is short, because both ends 81 and 82 in the rotational direction of the top face of the block 12 with a protrusion are the same in height.

The total height H of the block 12 with a protrusion is higher than the smooth block 13 by the height of the protrusion 25.

The rotor 10 has at the bottom face side a rotating shaft 20 projecting vertically and downwardly, as shown in FIG. 5. The rotating shaft 20 projects downwardly form a bottom face 22 of the concave portion 8. To a tip (lower end) of the rotating shaft 20 is attached a rotor gear 14 as shown in FIG. 5.

Figure 9:
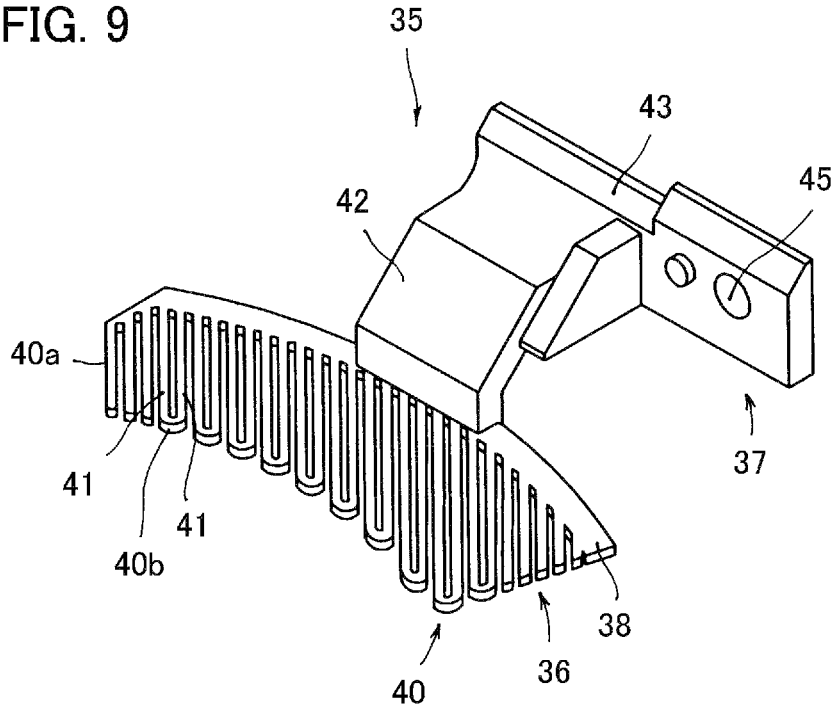
FIG. 9 is a perspective view of the separating member provided in the drug cassette.

Next, the separating member 35 will be described below. The separating member 35 is mainly composed of a main body 36 and a support 37 as shown in FIG. 9.

The main body 36 is shaped like a comb. Specifically, the main body 36 consists of a trunk part 38 and a large number of branches 40. The trunk part 38 is arcuately bent. In sum, the trunk part 38 has an arc shape. A large number of branches 40 project in a cantilever form from an inner peripheral face side of the trunk part 38. The branches 40 are disposed in parallel among others and wholly inclined to one direction. The inclination direction is arranged along the rotational direction of the rotor 10.

The branches 40 each are independent from its adjacent branches and separately bend regardless of deformation quantity of the adjacent branches 40.

In this embodiment, the branches 40 include branches 40*a* of a single-wire shape and branches 40*b* of a "U" shape like a hairpin.

Specifically, among a plurality of the branches 40, the branches 40*a* located at both ends and their vicinities are linear. In contrast, the branches 40*b* in the middle each are formed by parallel teeth 41 with their tips connected.

The support 37 of the separating member 35 is constituted by an plate-like arm 42 disposed at the outer peripheral side of the trunk part 38 and a fixing plate 43 disposed at the other end of the arm 42. The fixing plate 43 has a through-hole 45, through which a screw not shown is inserted so as to attach the separating member 35 to the storage part 5.

In this embodiment, the comb-like separating member 35 is horizontally inserted in the separating member insertion port 21 of the storage part 5. The separating member 35 is larger in length than the width of the drug discharging outlet 18. Specifically, the separating member 35 covers over the entire width of the drug discharging outlet 18 and further extends to the front and back of the rotational direction of the rotor 10.

In this embodiment, the main body 36 of the separating member 35 is located adjacent to the upper opening 16 of the rotor 10 and planarly occupies a certain amount of areas. In other words, the main body 36 of the separating member 35 extends in proximity to the upper part of the block forming region 15. Consequently, the main body 36 of the separating member 35 is located adjacent to the upper parts of the blocks 12 and 13.

Specifically, the rotor 10 is positioned in substantially vertical attitude, whereas the main body of the separating member 35 projects in substantially a horizontal direction within the storage part. The separating member 35 has substantially the same height as an average height of all the blocks 12 and 13.

More specifically, as described above, the highest point of the block 12 with a protrusion is higher than the highest point of the smooth block 13, while the lower face of the main body 36 of the separating member 35 is located in an intermediate position between the highest point of the block 12 with a protrusion and the highest point of the smooth block 13.

In sum, the lower face of the main body 36 of the separating member 35 is located at a higher position than the highest point of the smooth block 13 and at a lower position than the highest point of the block 12 with a protrusion.

Consequently, the apex 26 of the block 12 with a protrusion is located at a higher position than the lower face of the main body 36 of the separating member 35, so that the apex 26 of the block 12 with a protrusion is enabled to have contact with the lower face of the main body 36 of the separating member 35.

An area having a lower height of the upper face of the block 12 with a protrusion has no contact with the lower face of the main body 36 of the separating member 35.

No part of the smooth block 13 has contact with the lower face of the main body 36 of the separating member 35.

As described above, since the apex 26 of the block 12 with a protrusion has a height to be able to have contact with the lower face of the main body 36 of the separating member 35, the apex 26 of the block 12 with a protrusion strokes the lower face of the main body 36 of the separating member 35 upon rotation of the rotor 10. Specifically, when reaching a part below the separating member 35 according to the rotation of the rotor 10, the block 12 with a protrusion is brought into contact with the bottom face of the separating member 35 in the intermediate part of the inclined face 24.

Then, as the quantity of contact of those gradually increases, the apex 26 presses most strongly the main body 36 of the separating member 35.

With further rotation of the rotor 10, the apex 26 of the block 12 with a protrusion moves to the rotational direction, thereby shifting a part with which the apex 26 is brought into contact to the rotational direction.

Next, a working of the drug feeder of this embodiment will be described in detail below.

This embodiment works in the same manner as that of the prior art when a large number of tablets are filled in the drug cassette 2. Specifically, when the motor 50 incorporated in the support base 3 is driven with the drug cassette 2 mounted on the support base 3, a rotational force is transferred from a driving gear 51 to the rotor gear 14, thereby rotating the rotor 10 in a direction shown by an arrow (FIGS. 4 and 7), which rotates the drug storage grooves 31 disposed on the outer peripheral face of the rotor 10, as shown in FIG. 10. Then, the rotation of the rotor 10 agitates tablets in the storage part 5, so that the tablets enter the pocket 11 through the upper opening 16 of the pocket 11.

Then, with further rotation of the rotor 10, the pockets 11 sequentially reach the drug discharging outlet 18, and whereby the tablets held in the pockets 11 are sequentially discharged through the drug discharging outlet 18.

More specifically, in this embodiment, the tablets held in the pockets 11 are discharged one by one at time intervals.

Though the drug storage groove 31 is a groove opened at the upper and lower sides as described above, the upper opening 16 of the pocket 11 is closed by the separating member 35 when the pocket 11 reaches the drug discharging outlet 18 because the separating member 35 is located above the drug discharging outlet 18 and further above the drug storage groove 31. The separating member 35 is located above the drug discharging outlet 18 and further above the upper opening 16 of the pocket 11 and planarly occupies a certain amount of area. Consequently, though the tablets held in the pockets 11 are sequentially discharged through the drug discharging outlet 18 and the relevant pocket 11 becomes empty as shown in FIG. 10B, no tablet newly drops into the pocket 11 near the drug discharging outlet 18.

Consequently, only a specified number of tablets having been initially held in the pocket 11 are discharged through the drug discharging outlet 18.

Figure 10A:
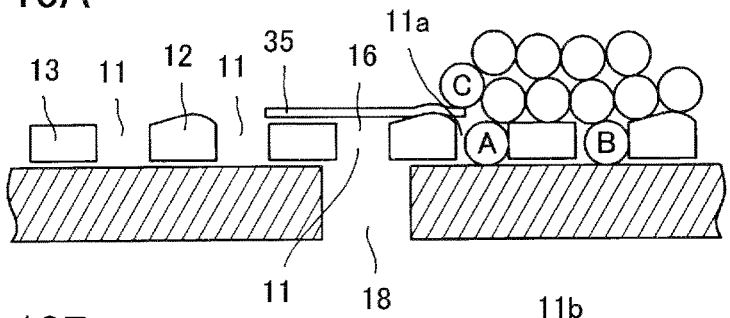
FIGS. 10A to E are explanatory drawings showing actions of the drug feeder in FIG. 1.
Figure 10B:
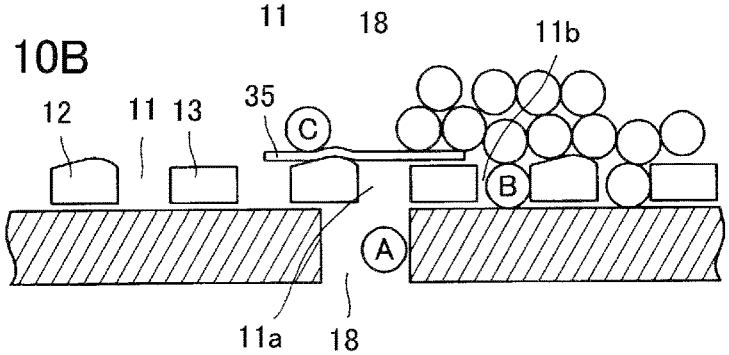

In an explanation with an example shown in FIGS. 10A to E, only one tablet A having been held in the pocket 11*a* is discharged through the drug discharging outlet 18 as shown in FIG. 10B, while a tablet C over the tablet A remains on the separating member 35.

Figure 10C:
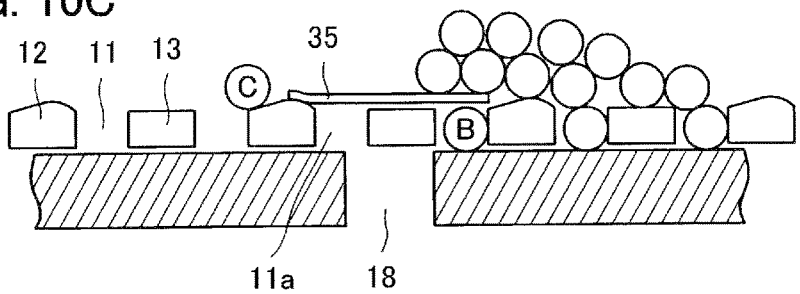
Figure 10D:
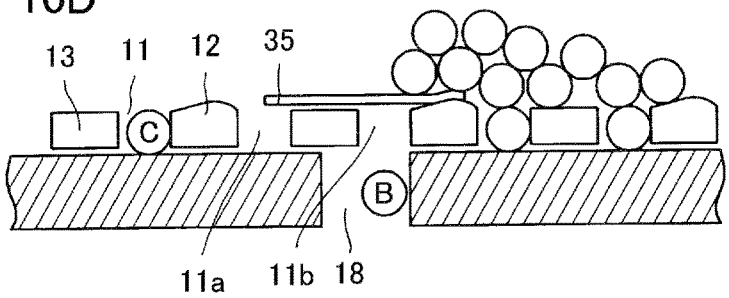
Figure 10E:
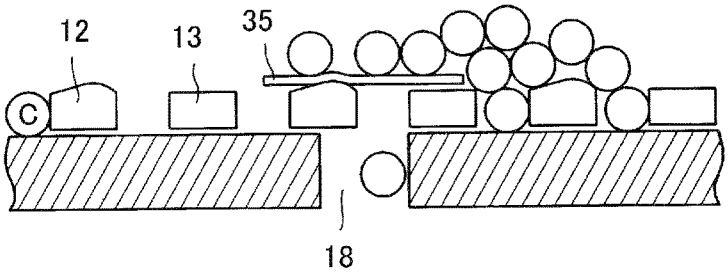

Upon further rotation of the rotor 10, only one tablet B having been held in the next pocket 11*b* as shown in FIG. 10D is discharged through the drug discharging outlet 18, while a tablet over the tablet A remains on the separating member 35.

At this point of time, in a case where a large number of tablets remain in the storage part, the tablets wholly and widely rotate following the rotation of the rotor 10 as shown in FIGS. 10A and B, so that the tablet C on the separating member 35 is pushed with its front and rear tablets, so as to move to the rotational direction of the rotor 10. Finally, as shown in FIG. 10C, the tablet C is pushed out from the separating member 35.

Hence, when a large number of the tablets remain in the storage part, no tablet stops on the separating member 35.

Next, a specific working of this embodiment will be described below. The drug feeder 1 of this embodiment exhibits an effect in a case where a small number of tablets remain in the drug cassette 2.

Specifically, when a small number of tablets remain in the drug cassette 2, the tablets become unable to wholly rotate, which cannot push out tablets loading on the separating member 35 with a moving force of other tablets.

However, in the drug feeder 1 of this embodiment, a part of the rotor 10 deforms the separating member 35 by being brought into contact with the separating member 35, so that a tablet is pushed out by the movement of a deformed part. The drug feeder 1 of this embodiment brings a part of the rotor 10 into contact with the separating member 35, thereby giving a motion to the separating member 35 so as to push out the tablets.

As described above, since the apex 26 of the block 12 with a protrusion has a height enough to have contact with the lower face of the main body 36 of the separating member 35, the apex 26 of the block 12 with a protrusion strokes the lower face of the main body 36 of the separating member 35 upon rotation of the rotor 10. In sum, when reaching below the separating member 35 upon rotation of the rotor 10, the block 12 with a protrusion pushes the main body 36 by the vicinity of the apex 26 (FIGS. 11A to D).

Ideally, the block 12 is brought into contact with the separating member 35 from the lower part of the gentle slope, which is the inclined face 24 of the front part 28 in the rotational direction, and gradually pushes the separating member 35 upward.

Herein, the main body 36 of the separating member 35 is shaped like a comb, so that a plurality of branches 40 are independent from their respective adjacent branches 40 and bend solely regardless of deformation quantity of the adjacent branches 40.

Therefore, as shown in FIGS. 12A to D, only the branches 40 having been brought into contact with the apex 26 of the block 12 with a protrusion and its vicinity among a large number of the branches 40 bend and deform upward. However, the other branches 40 maintain its original height without deformation.

Figure 11A:
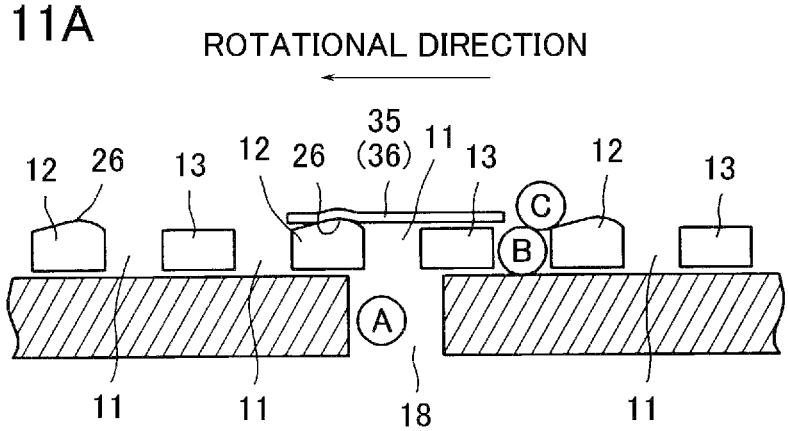
FIGS. 11A to D are explanatory drawings showing operations of the drug feeder in FIG. 1 when a small number of tablets remain.
Figure 11B:
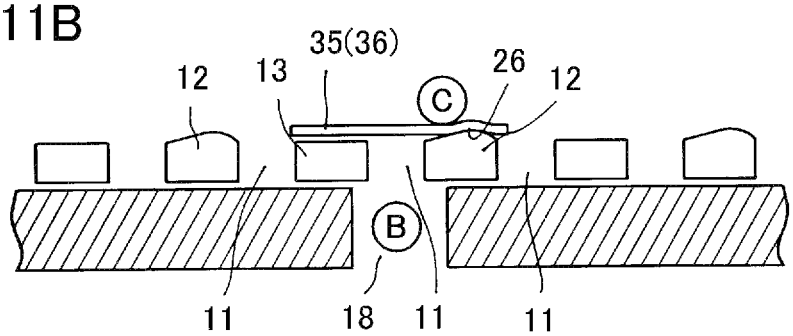
Figure 11C:
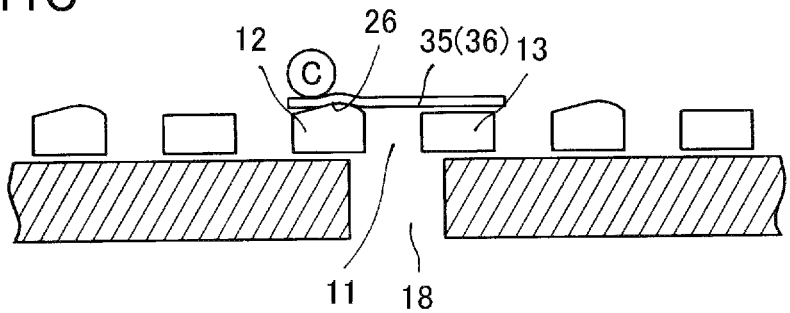
Figure 11D:
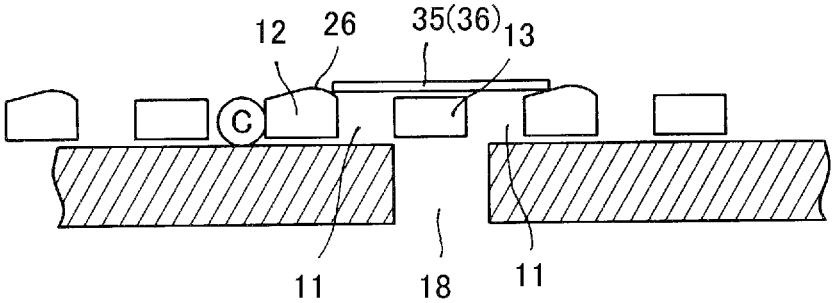
Figure 12A:
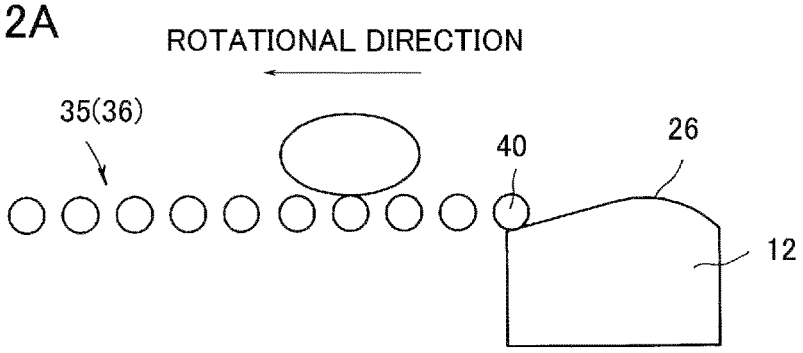
FIGS. 12A to D are partially enlarged explanatory drawings of FIG. 11.
Figure 12B:
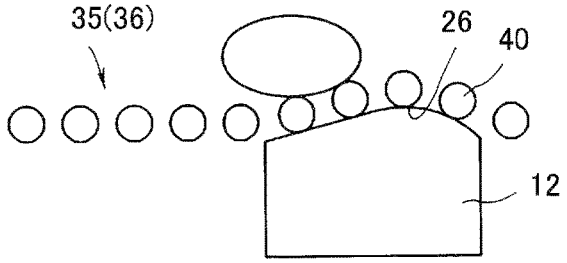
Figure 12C:
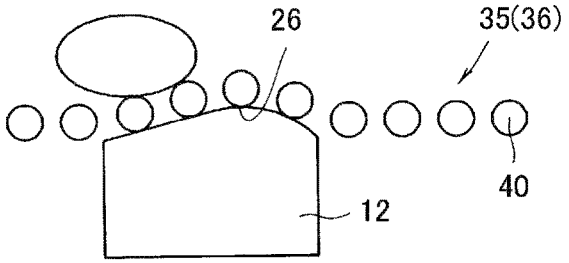
Figure 12D:
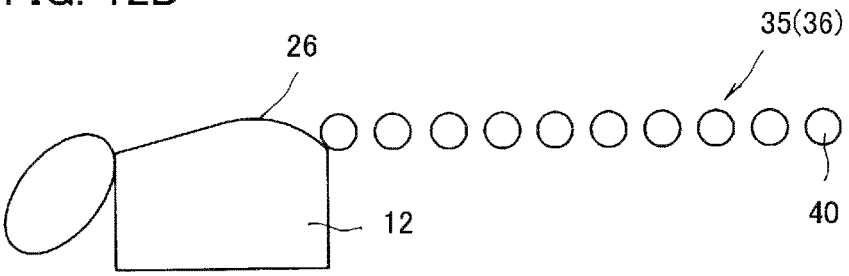

Upon further rotation of the rotor 10, the apex 26 of the block 12 with a protrusion moves to the rotational direction, as shown in FIG. 11B and FIG. 12B. A position with which the apex 26 has contact is shifted in the rotational direction following to the movement of the apex 26. Specifically, the branches 40 to be deformed upward successively replace so as to proceed as if sea waves run. Then, the tablets loaded on the main body 36 of the separating member 35 move forward in the rotational direction by being pushed by these waves. Finally, the tablets leave from the separating member 35, drop in, and enter the drug storage groove 31 (pocket 11) of the rotor 10. After one rotation of the rotor 10, when the pocket 11 holding the tablets reach the drug discharging outlet 18, the tablets are discharged out through the drug discharging outlet 18.

Therefore, the drug feeder 1 of this embodiment discharges the last tablet until none is left.

The above-mentioned embodiment is alternately provided with the block 12 with a protrusion having the protrusion 25 and the smooth block 13 without the protrusion 25. This configuration is recommended as preventing the separating member 35 from excessively having contact with the protrusion 25. However, this invention is not limited thereto and may be provided with the protrusions 25 on all the blocks 12 and 13. Alternatively, the heights of all the blocks 12 and 13 may be aligned to be able to contact with the separating member 35 without the protrusion 25.

Alternatively, there is another configuration in which a part other than the blocks 12 and 13 is brought into contact with the separating member 35. Further, it is possible to provide another member rotating with the rotor 10 and bring a part of the member into contact with the separating member 35.

Figure 19:
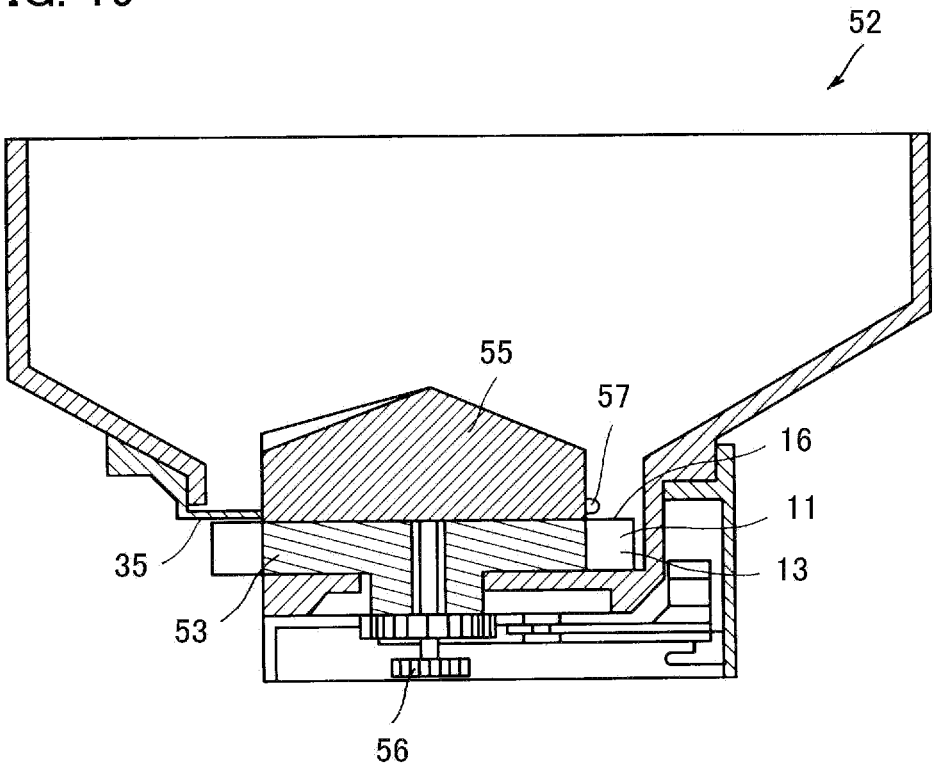
FIG. 19 is a cross section of a drug feeder of another embodiment of the present invention.
Figure 20A:
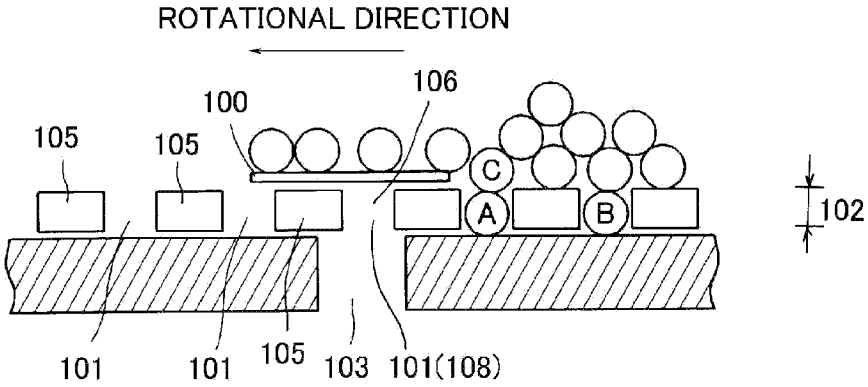
FIGS. 20A to E are explanatory drawings showing actions of a drug feeder in the known art.
Figure 20B:
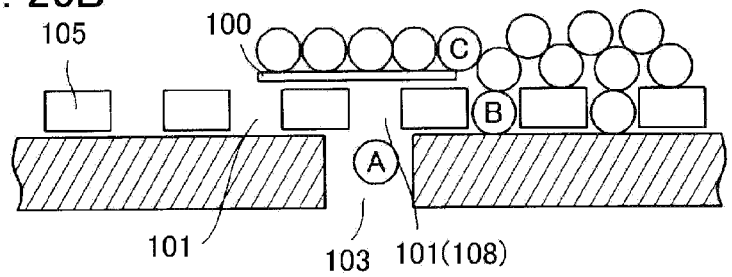
Figure 20C:
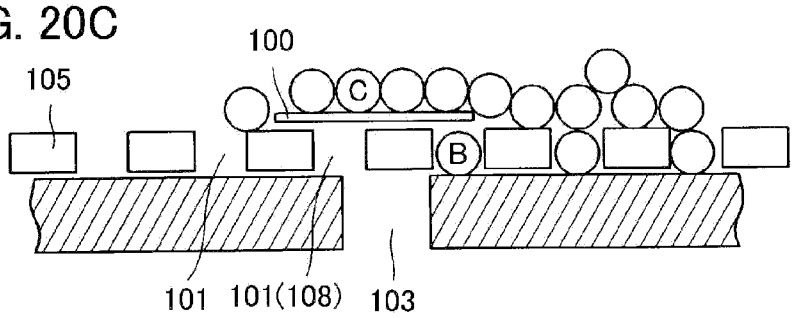
Figure 20D:
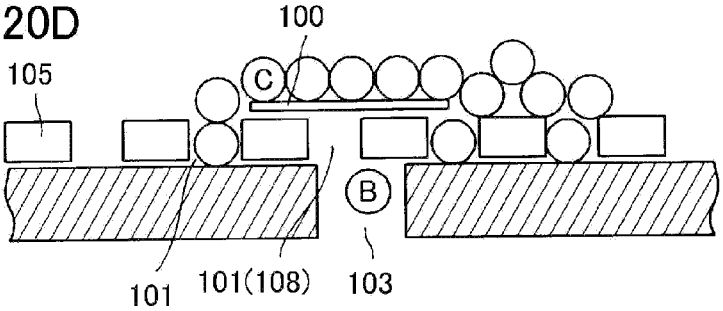
Figure 20E:
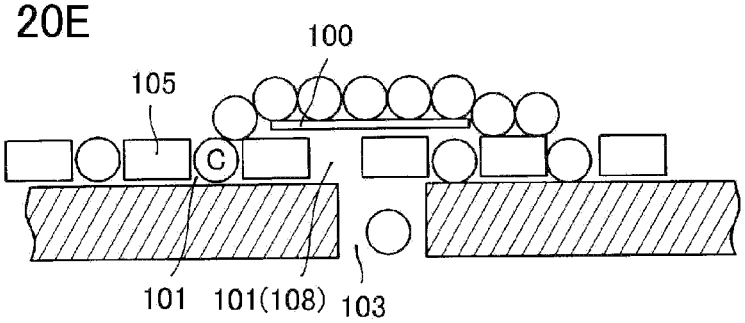
Figure 21A:
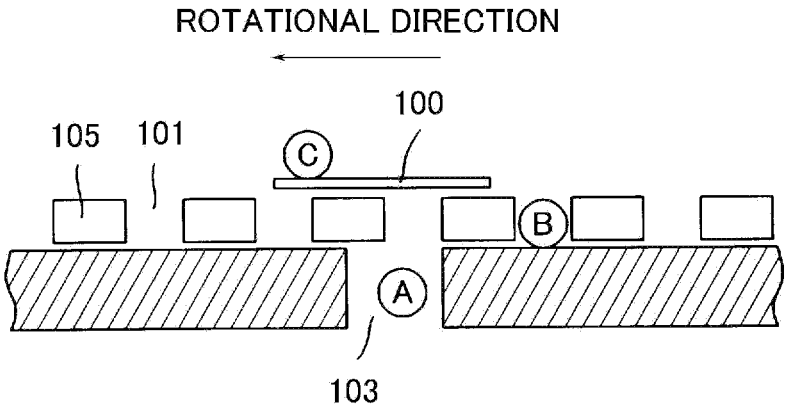
FIGS. 21A to C are explanatory drawings showing operations of the drug feeder in the known art when a small number of tablets remain.
Figure 21B:
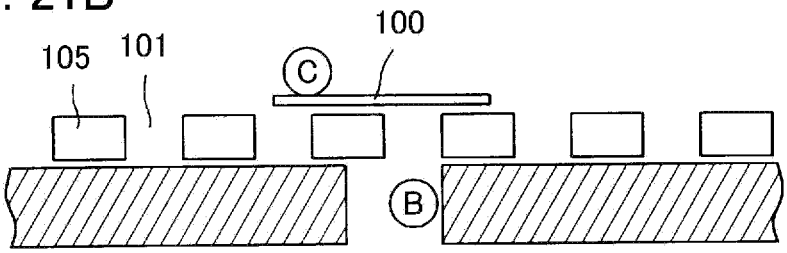
Figure 21C:
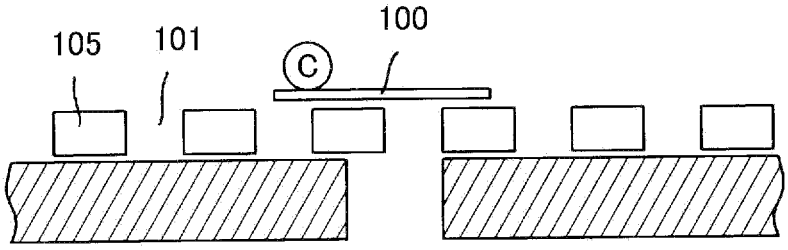
Figure 22:
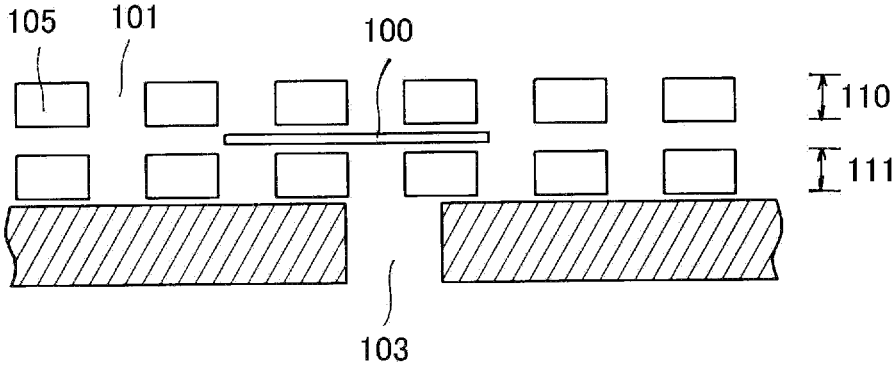
FIG. 22 is an explanatory drawing of a drug feeder in the known art that employs a rotor provided with upper and lower pocket region.
Figure 23A:
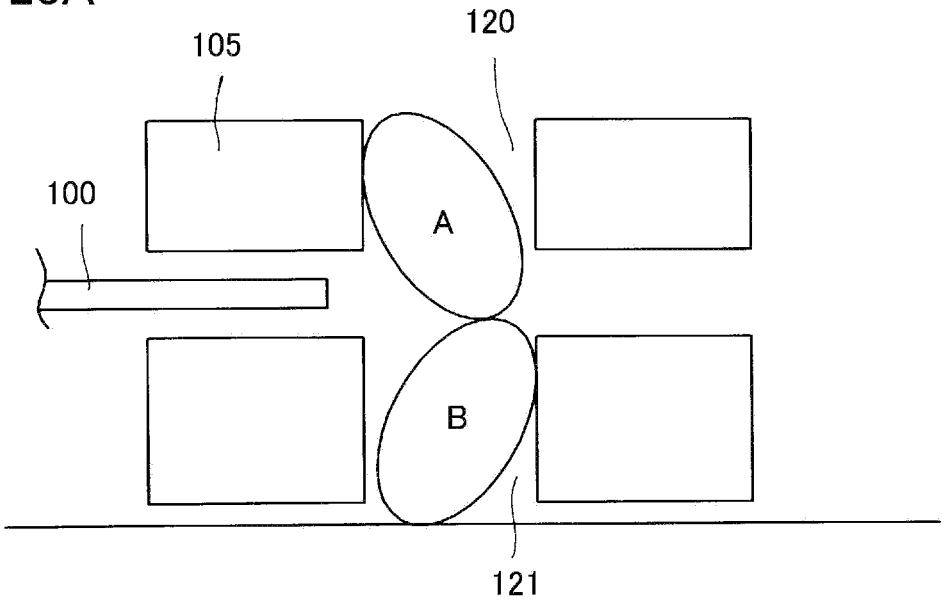
FIGS. 23A and B are explanatory drawings showing actions of the drug feeder in the known art, FIG. 23A showing a state in which tablets enter a pocket in a normal attitude and FIG. 23B showing a state in which tablets enter a pocket in an abnormal attitude.
Figure 23B:
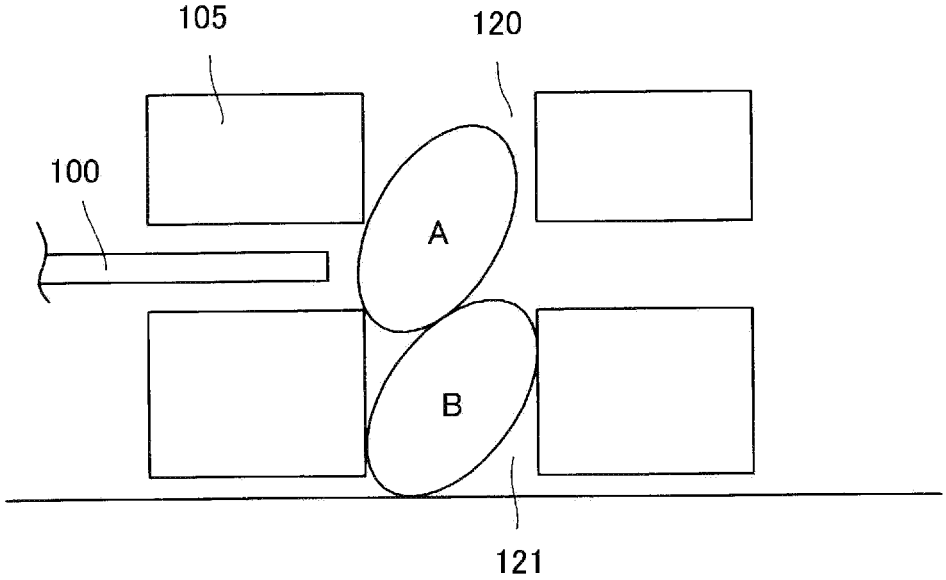
Figure 24A:
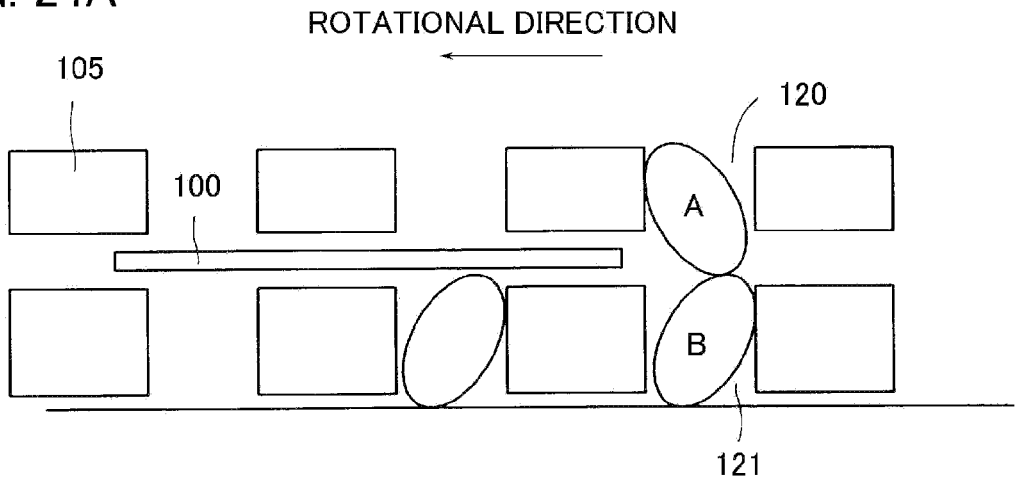
FIGS. 24A and B are explanatory drawings showing actions of the drug feeder in the known art, in which a relationship between tablets and a separating member when the tablets enter the pocket in a normal attitude.
Figure 24B:
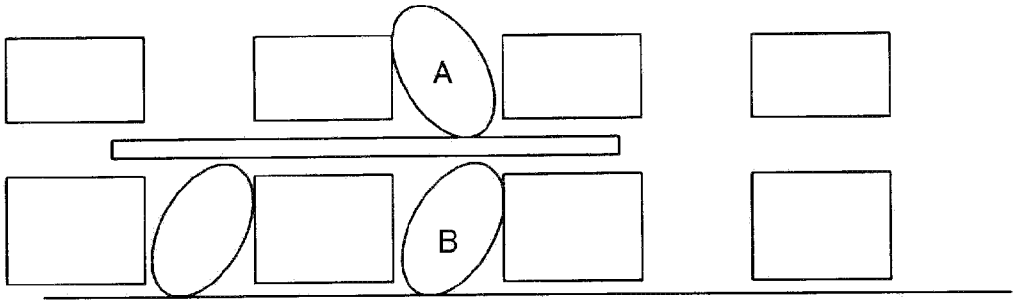
Figure 25C:
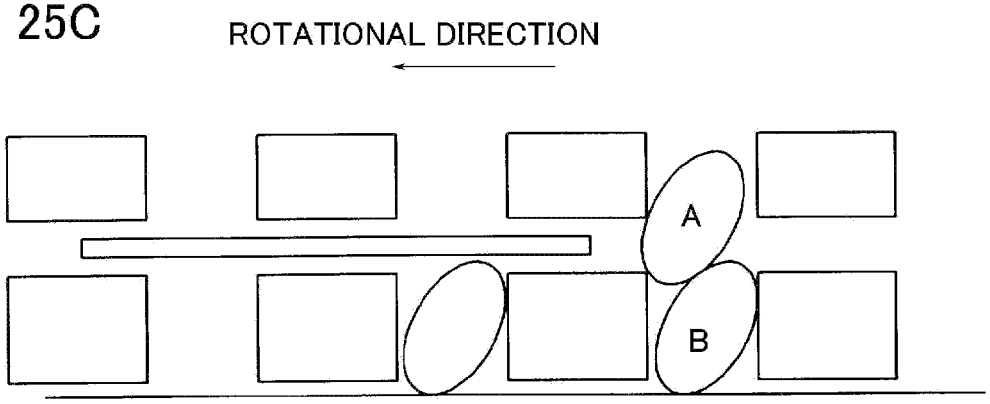
FIGS. 25C and D are explanatory drawings showing actions of the drug feeder in the known art, in which a relationship between tablets and the separating member when the tablets enter the pocket in an abnormal attitude.
Figure 25D:
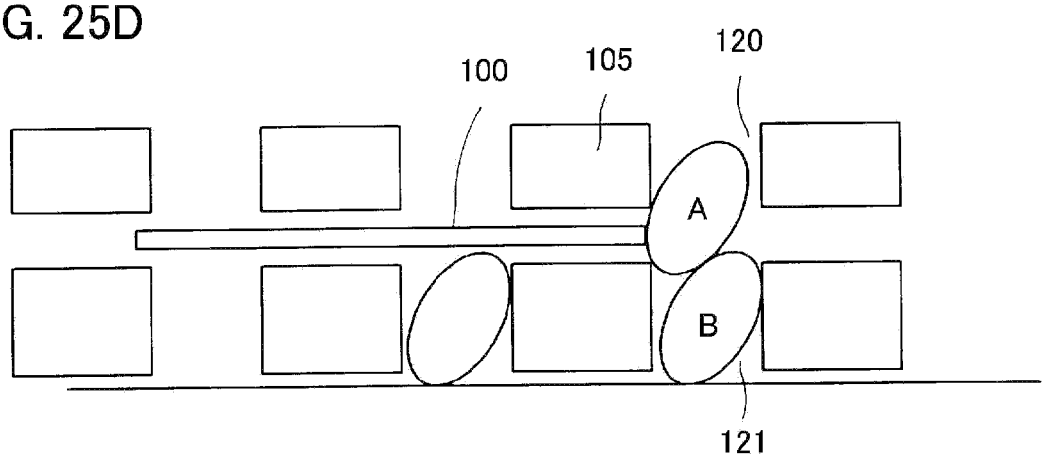
Figure 26A:
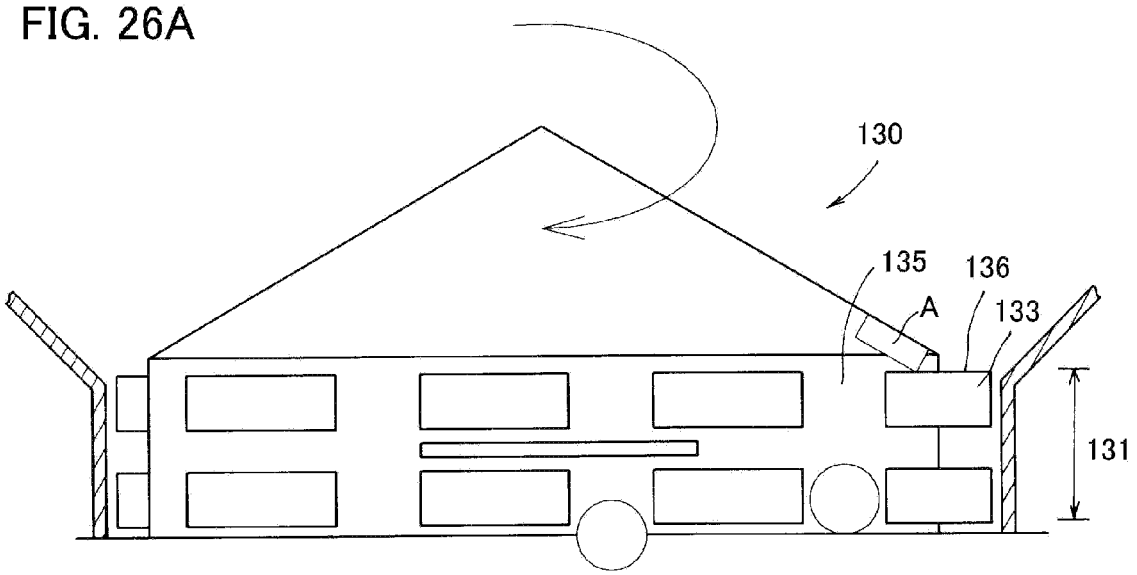
FIGS. 26A and B are explanatory drawings showing actions of the drug feeder in the known art, FIG. 26A showing a state in which a tablet has stopped on a block and FIG. 26B showing a state in which the rotor rotates in the state in FIG. 26A.
Figure 26B:
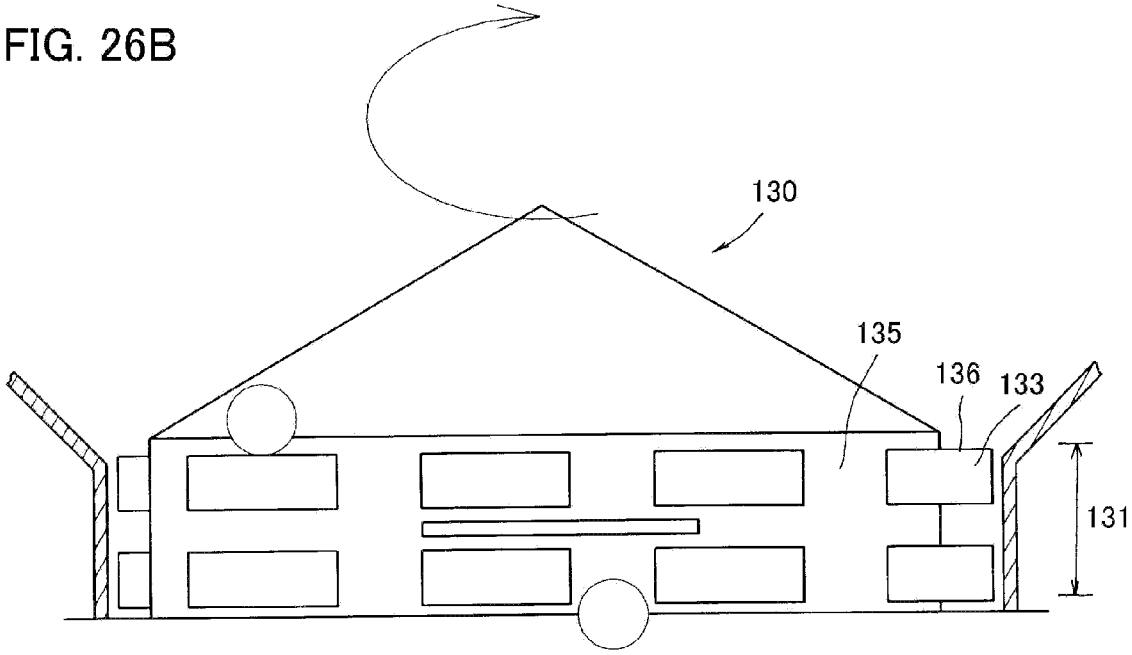
Figure 27A:
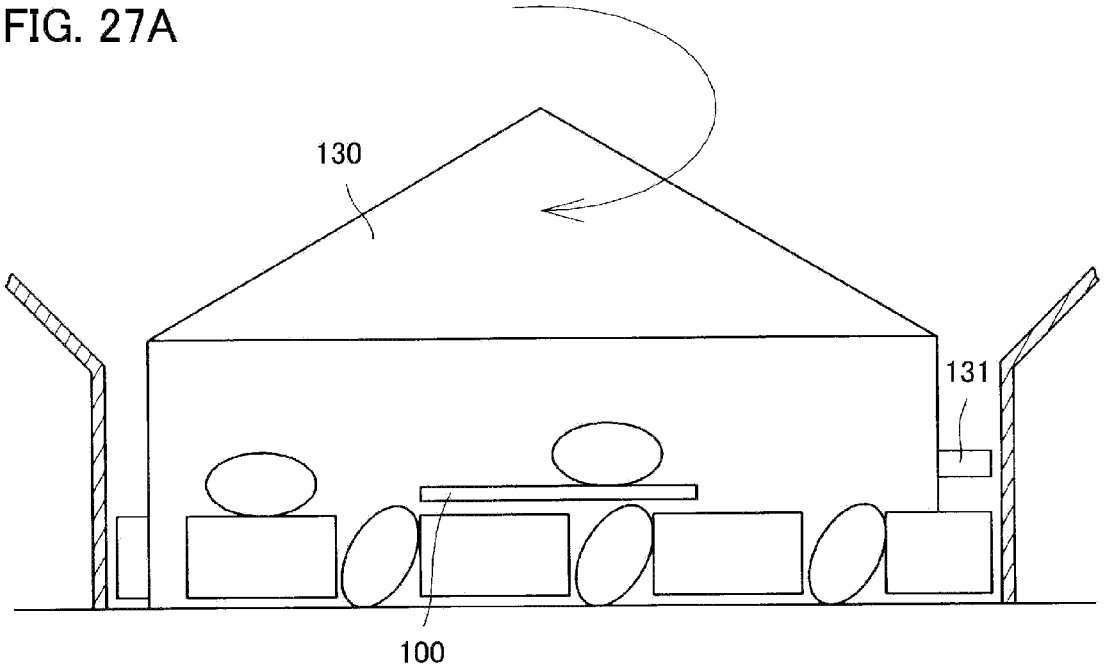
FIGS. 27A and B are explanatory drawings showing actions of the drug feeder having been discussed by the present inventors.
Figure 27B:
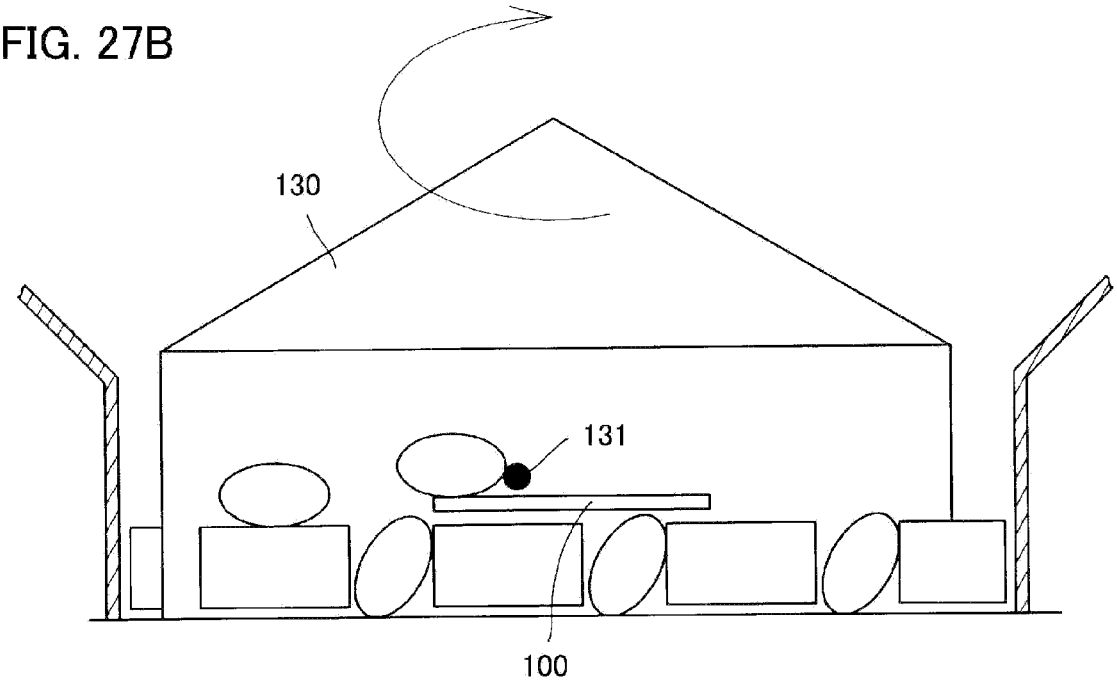

A drug cassette 52 shown in FIG. 19, for example, has on a rotor 53 an agitating member 55 for agitating drugs. The rotor 53 rotates by the rotor gear 14 and the agitating member 55 rotates by an agitating member rotor gear 56. Direct rotation of the rotor gear 14 and the agitating member rotor gear 56 with the same motor (not shown) rotates the agitating member 55 with the rotor 53. In contrast, rotation of the rotor gear 14 and the agitating member rotor gear 56 with separate motors or interposition of a clutch mechanism therebetween rotates the agitating member 55 separately from the rotor 53.

The drug cassette 52 of this embodiment is provided with a protrusion-shaped contact portion 57 on the side face of the agitating member 55.

In the drug cassette 52 shown in FIG. 19, the contact portion 57 of the agitating member 55 is located above the smooth blocks 13 and above the upper opening 16 of the pocket 11. Further, the contact portion 57 of the agitating member 55 has a height above ground being lower than the separating member 35. Herein, the contact portion 57 of the drug cassette 52 shown in FIG. 19 has the same height above ground as the height of the protrusion 25 of the block 12 with a protrusion of the drug cassette 2 in the foregoing embodiment (FIG. 1, etc.).

Since the protrusion-shaped contact portion 57 in this embodiment is located at the same position as that in the foregoing embodiment, the contact portion 57 rotates associated with the rotation of the rotor 53, but the contact portion 57 passes between a tablet contained in the pocket 11 and a tablet above the pocket 11 (both tablets not shown), so as not to excessively hit against the tablets.

Figure 28:
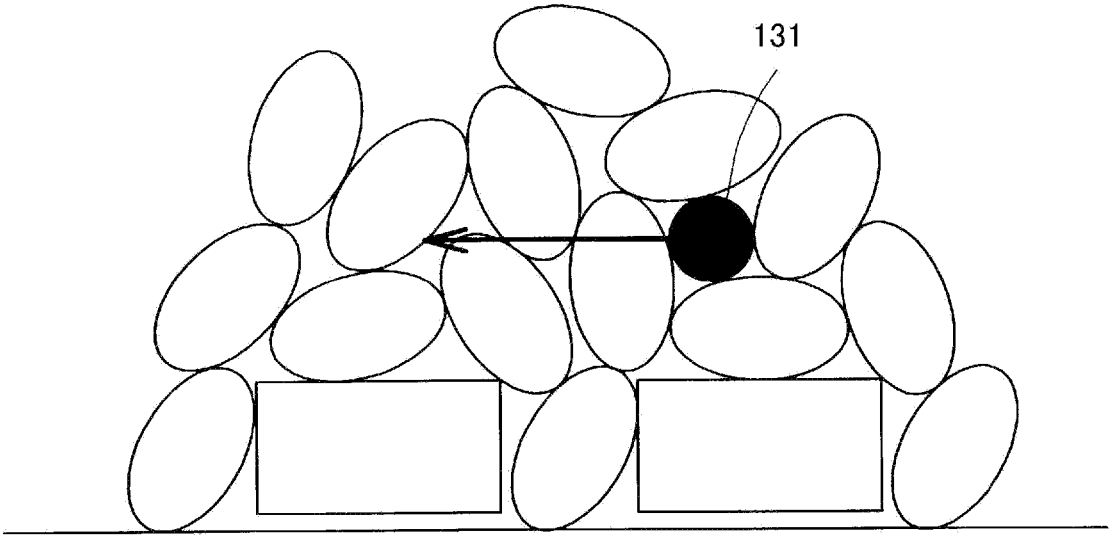
FIG. 28 is an explanatory drawing explaining a problem of the drug feeder shown in FIG. 27.

Specifically, with being brought into contact with an upper part of a tablet in the pocket 11 and lower parts of other tablets according to the rotation of the rotor 53, the contact portion 57 moves so as to partition the upper and lower parts described above. Consequently, no excessive hitting occurs unlike the above-mentioned case shown in FIG. 28, which never damages tablets.

In the drug cassette 52 shown in FIG. 19, the agitating member 55 rotates with the rotor 53 in discharging drugs, thereby bringing the contact portion 57 into contact with the separating member 35.

Herein, the agitating member 55 preferably rotates simultaneously with the rotation of the rotor 53. The rotation number of the agitating member 55 does not necessarily to match that of the rotor 53.

This embodiment illustrates the agitating member 55 as an example of "the member to rotate with the rotor 53 associated with the rotation of the rotor 53" and "the member to be rotatable separately from the rotor 53," but a contact portion may be disposed on a rotation member without an agitating function. In a case where the contact portion is disposed on the rotation member without the agitating function, the rotation member does not necessarily rotate simultaneously with the rotation of the rotor 53. In sum, the contact portion may rotate at a different timing from the rotor. For example, only the contact portion may rotate prior to rotation of the rotor 53 or the contact portion may rotate after a tablet has not been discharged so as to move a tablet having been loaded on the separating member 35.

The above-mentioned embodiment is provided with the inclined face 24 at the front part of the protrusion 25. This configuration is recommended because mitigating an impact on the separating member 35. However, provision of the inclined face 24 is not essential. Further, the inclined face 27 disposed at the back part of the protrusion 25 effectively prevents the protrusion 25 from being caught by the rotor 10 when the rotor 10 is made rotated in a counter direction, but similarly, it is not an essential configuration.

In this embodiment, the block 12 has one protrusion 25, but may have a plurality of protrusions.

Figure 13:
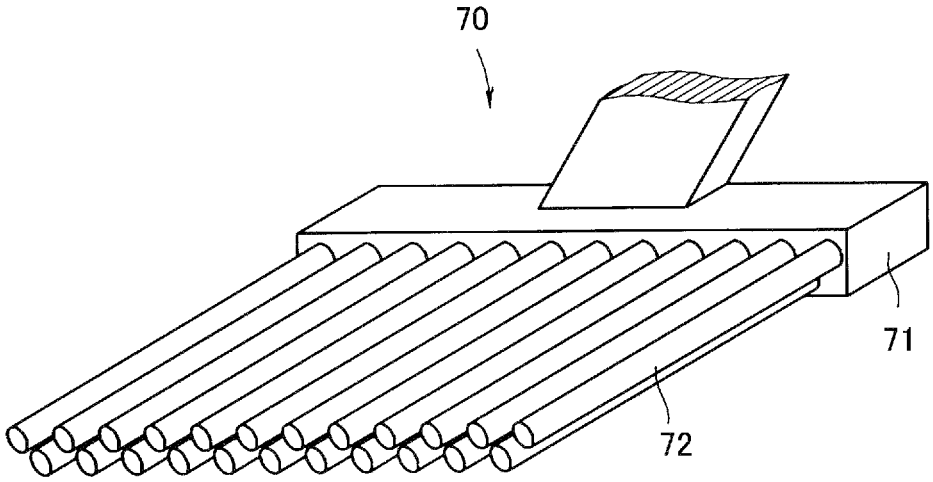
FIG. 13 is a perspective view of another embodiment of the separating member.
Figure 14:
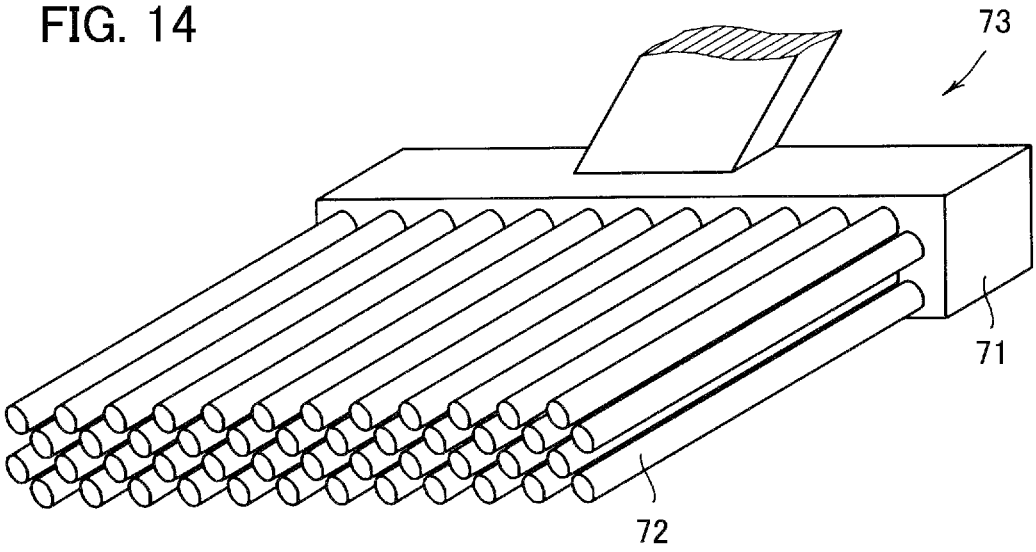
FIG. 14 is a perspective view of a still another embodiment of the separating member.

Further, the above-mentioned separating member 35 illustrates one having a comb shape and constituted by the trunk part 38 and a large number of the branches 40 aligned on a level surface, but the present invention is not limited to this configuration. As in a separating member 70 shown in FIG. 13, for example, it may be configured in such a manner that a large number of branches 72 are mounted on the trunk part 71 so as to align at upper and lower stages on two level surfaces. Alternatively, as in a separating member 73 shown in FIG. 14, it may be configured in such a manner that a large number of branches 72 are mounted on the trunk part 71 so as to align at a plurality of stages to show one flat plate shape as a whole. In sum, the separating member 35 is not limited to a comb shape, and may be a brush shape.

In a case of employment of the configuration of the branches 40 aligned at the upper and lower stages like the separating member 70 or the branches 40 aligned at a plurality of stages like the separating member 73, members such as the protrusion 25 to be brought into contact with the separating member 70 or 73 preferably have heights higher than the case of the forgoing embodiment because the separating member 70 or 73 increases in thickness.

Figure 15:
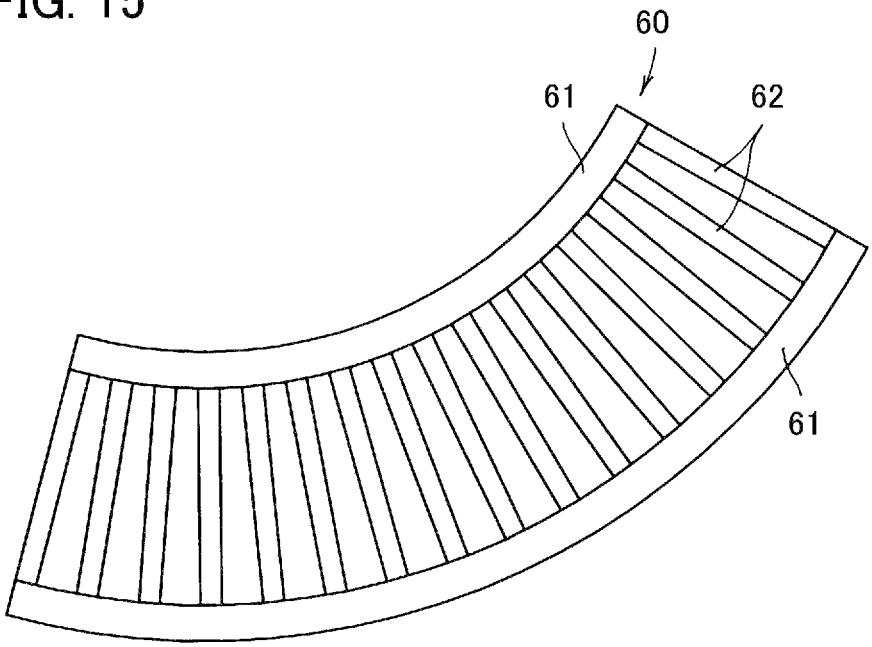
FIG. 15 is a plan view of a yet another embodiment of the separating member.

Further, it is possible to employ a ladder-shaped separating member 60 as shown in FIG. 15, for example. The separating member 60 is configured by a large number of branches 62 bridged in parallel between two parallel main bodies 61. The ladder-shaped separating member 60 also gives each branch 62 different deformation quantity from its adjacent branches 62.

Figure 16:
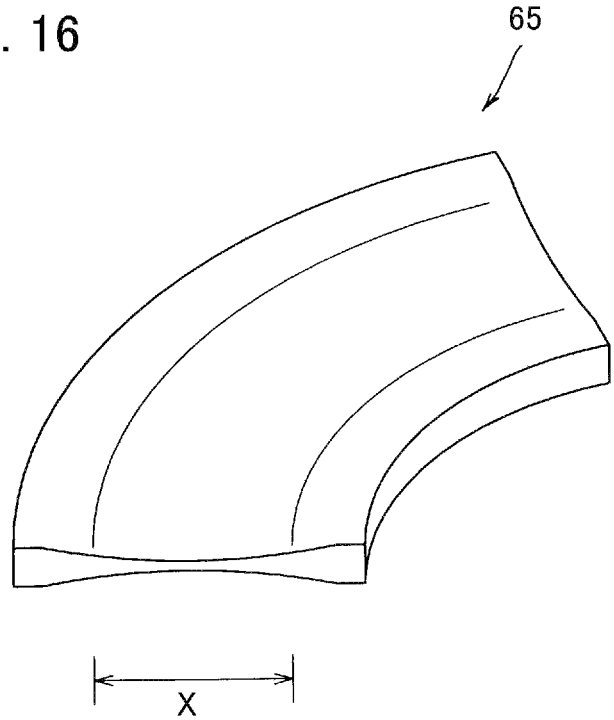
FIG. 16 is a perspective view of a yet still another embodiment of the separating member.

Further, as in a separating member 65 shown in FIG. 16, it is possible to form a region X to be readily deformed in a part in the width direction so as to bring a protrusion into contact with the region X to form a waved shape.

Figure 17:
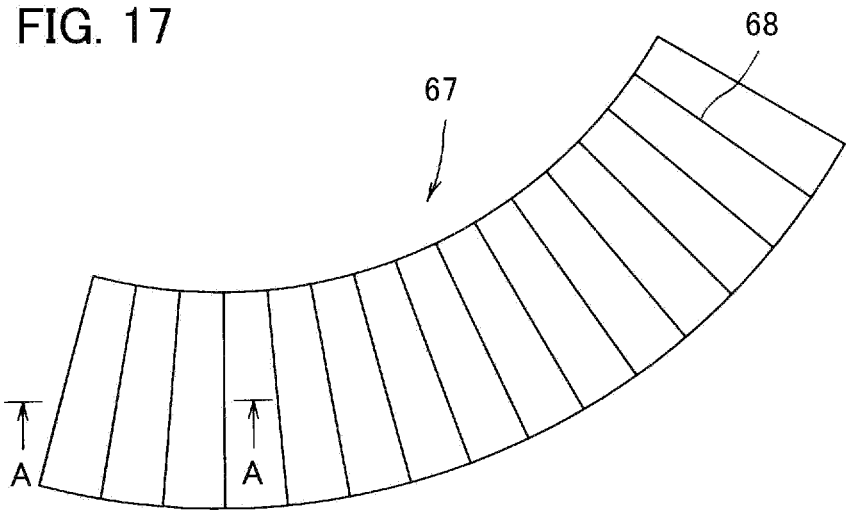
FIG. 17 is a plan view of a further embodiment of the separating member.
Figure 18:
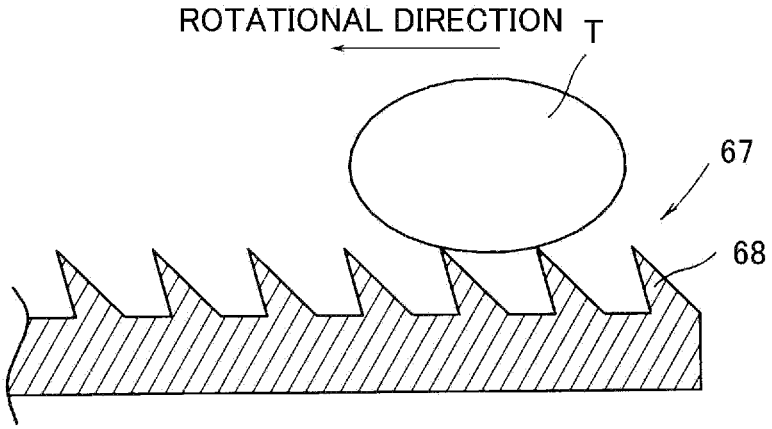
FIG. 18 is an enlarged view of FIG. 17 taken along a cross section A-A.

Further, as in a separating member 67 shown in FIGS. 17 and 18, it is possible to provide a large number of ratchet teeth (reversing prevention portions) 68 on its surface so as to allow tablets move to only one direction. In employment of this configuration, only giving vibration to the separating member 67 moves tablets loaded thereon forward.

Herein, the separating member 67 as shown in FIGS. 17 and 18 is employed instead of the separating member 35 employed in the embodiment shown in FIGS. 4, 5, and 6.

In this embodiment, the protrusion 25 of the block 12 with a protrusion intermittently hits against the separating member 35 according to the rotation of the rotor 10, thereby vibrating the separating member 67. As the separating member 67 is provided with a large number of ratchet teeth (reversing prevention portions) 68 on its surface so as to allow tablets to move to only one direction, the tablets move forward. In short, in this embodiment, a motion of vibration makes tablets proceed.

DESCRIPTION OF NUMERALS

1. drug feeder
5. storage part

10. rotor
11. pocket
12. block with a protrusion
13. smooth block
16. upper opening
18. drug discharging outlet
24. inclined face
25. protrusion
26. apex
27. inclined face
31. drug storage groove
32. drug storage space
35. separating member
40. branch
60. separating member
65. separating member
67. separating member
70. separating member
73. separating member
72. branch

The invention claimed is:

1. A drug feeder comprising:

a storage part having an inner wall, a drug storage space for accommodating a number of solid drugs and a drug discharging outlet for discharging the drugs;

a rotor having a side face with drug storage grooves formed thereon; and a separating member disposed in the drug storage space, wherein the rotor is rotatably installed in the storage part, the inner wall of the storage part and the drug storage grooves of the rotor define pockets, the pockets having upper sides with openings toward the drug storage space so as to enable the drugs in the drug storage space to drop into the pockets, the separating member is located above a height of the openings of the pockets and extends above the drug discharging outlet so as to occupy a predetermined amount of area planarly, the separating member preventing more than a predetermined number of the drugs from dropping into the drug discharging outlet from each of the pockets, the rotor is operable to rotate in the storage part to sequentially discharge the drugs from the storage part held in each of the pockets through the drug discharging outlet by sequentially communicating the pockets with the drug discharging outlet, and the rotor has a part that hits against a top part of the separating member so as to give a vertical motion to the separating member when the rotor is rotated to move any of the drugs in the drug storage space that are located on the separating member.

2. A drug feeder comprising:

a storage part having an inner wall, a drug storage space for accommodating a number of solid drugs and a drug discharging outlet for discharging the drugs;

a rotor having a side face with drug storage grooves formed thereon;

a separating member disposed in the drug storage space; and a member having a top, wherein the rotor is rotatably installed in the storage part, the inner wall of the storage part and the drug storage grooves of the rotor define pockets, the pockets having upper sides with openings toward the drug storage space so as to enable the drugs in the drug storage space to drop into the pockets, the separating member is located above a height of the openings of the pockets and extends above the drug discharging outlet so as to occupy a predetermined amount of area planarly, the separating member preventing more than a predetermined number of the drugs from dropping into the drug discharging outlet from each of the pockets, the rotor is operable to rotate in the storage part to sequentially discharge the drugs from the storage part held in each of the pockets through the drug discharging outlet by sequentially communicating the pockets with the drug discharging outlet, and the member having a top either rotates with the rotor or rotates separately from the rotor and hits against a part of the separating member so as to give a vertical motion to the separating member when the member is rotated to move any of the drugs in the drug storage space that are located on the separating member.

3. The drug feeder as defined in claim 1, wherein the separating member is disposed so as to extend in substantially a horizontal direction, the separating member having an upper face on which the drugs are loadable.

4. The drug feeder as defined in claim 1, wherein the rotor is provided with blocks on the side face at intervals, the drug storage grooves are formed by gaps between adjacent pairs of the blocks, and at least a part of an upper face of each of the blocks hits against a lower face of the separating member when the rotor is rotated.

5. The drug feeder as defined in claim 1, wherein the rotor is provided with a protrusion, and the protrusion hits against a lower face of the separating member when the rotor is rotated.

6. The drug feeder as defined in claim 1, wherein the rotor is provided with blocks on the side face at intervals, and the blocks include both a block with a protrusion to hit against a lower face of the separating member and a block with no protrusion.

7. The drug feeder as defined in claim 5, wherein the protrusion has an apex with inclined faces in a front part and a rear part of the apex in a rotational direction.

8. The drug feeder as defined in claim 7, wherein the inclined face toward a front end in the rotational direction has a gentler slope than the inclined face toward a rear end in the rotational direction.

9. The drug feeder as defined in claim 5, wherein the protrusion has an apex having a rounded cross section.

10. The drug feeder as defined in claim 1, wherein the separating member is partially deformable, and the part of the separating member against which the part of the rotor hits deforms more than another part of the separating member, so that the deformed part moves to push out the drugs when the rotor is rotated.

11. The drug feeder as defined in claim 6, wherein the protrusion has an apex with inclined faces in a front part and a rear part of the apex in a rotational direction.

12. The drug feeder as defined in claim 11, wherein the inclined face toward a front end in the rotational direction has a gentler slope than the inclined face toward a rear end in the rotational direction.

13. The drug feeder as defined in claim 6, wherein the protrusion has an apex having a rounded cross section.

14. The drug feeder as defined in claim 2, wherein
the separating member is disposed so as to extend in substantially a horizontal direction, the separating member having an upper face on which the drugs are loadable.

15. The drug feeder as defined in claim 2, wherein
the rotor is provided with blocks on the side face at intervals,
the drug storage grooves are formed by gaps between adjacent pairs of the blocks, and
at least a part of an upper face of each of the blocks hits against a lower face of the separating member when the rotor is rotated.

16. The drug feeder as defined in claim 2, wherein
the rotor is provided with a protrusion, and
the protrusion hits against a lower face of the separating member when the rotor is rotated.

17. The drug feeder as defined in claim 2, wherein
the rotor is provided with blocks on the side face at intervals, and
the blocks include both a block with a protrusion to hit against a lower face of the separating member and a block with no protrusion.

18. The drug feeder as defined in claim 16, wherein
the protrusion has an apex with inclined faces in a front part and a rear part of the apex in a rotational direction,
the inclined face toward a front end in the rotational direction has a gentler slope than the inclined face toward a rear end in the rotational direction, and
the apex of the protrusion has a rounded cross section.

19. The drug feeder as defined in claim 17, wherein
the protrusion has an apex with inclined faces in a front part and a rear part of the apex in a rotational direction,
the inclined face toward a front end in the rotational direction has a gentler slope than the inclined face toward a rear end in the rotational direction, and
the apex of the protrusion has a rounded cross section.

20. The drug feeder as defined in claim 2, wherein
the separating member is partially deformable, and
the part of the separating member against which the member hits deforms more than another part of the separating member, so that the deformed part moves to push out the drugs when the member is rotated.

* * * * *